US005765605A

United States Patent [19]

Waymire et al.

[11] Patent Number: 5,765,605

[45] Date of Patent: Jun. 16, 1998

[54] DISTRIBUTED CONCENTRATED CHEMICAL DISPENSING SYSTEM

[75] Inventors: Gary L. Waymire, Menlo Park; Michael R. Barry, Palo Alto, both of Calif.; Carey W. Zimmerman, Racine, Wis.; Raymond McKinnon, Castro Valley, Calif.; Thomas A. Helf, New Berlin; Charles E. Seaman, Jr., Kenosha, both of Wis.

[73] Assignee: SC Johnson Commerical Markets, Inc., Sturtevant, Wis.

[21] Appl. No.: 663,650

[22] Filed: Jun. 14, 1996

[51] Int. Cl.[6] ..... B65B 1/04

[52] U.S. Cl. ..... 141/100; 141/9; 141/2; 141/18

[58] Field of Search ..... 141/2, 1, 9, 18, 141/21, 98, 100, 102, 103, 104, 105, 106, 107; 222/1, 132, 133, 129, 145.1, 145.4, 145.5, 145.7; 239/304, 307, 310, 318, 526, 569

[56] References Cited

U.S. PATENT DOCUMENTS

| | | |
|---|---|---|
| D. 289,675 | 5/1987 | Beal et al. . |
| 912,106 | 2/1909 | Frazier . |
| 1,920,721 | 8/1933 | Tirrell . |
| 2,030,853 | 2/1936 | Budwig . |
| 2,061,932 | 11/1936 | Budwig . |
| 2,744,791 | 5/1956 | Budwig . |
| 2,800,313 | 7/1957 | Targosh et al. . |
| 2,940,673 | 6/1960 | Budwig . |
| 2,948,480 | 8/1960 | Budwig . |
| 2,951,645 | 9/1960 | Price et al. . |
| 3,027,097 | 3/1962 | Gleason et al. . |
| 3,032,274 | 5/1962 | Budwig . |
| 3,072,137 | 1/1963 | McDougall . |
| 3,088,679 | 5/1963 | Ford . |
| 3,166,086 | 1/1965 | Holmes . |
| 3,323,686 | 6/1967 | Roth . |
| 3,445,067 | 5/1969 | Sheldall . |
| 3,756,473 | 9/1973 | Donahue, Jr. . |
| 3,933,179 | 1/1976 | Hechler, IV . |
| 3,940,069 | 2/1976 | Gunzel, Jr. et al. . |

(List continued on next page.)

FOREIGN PATENT DOCUMENTS

| | | |
|---|---|---|
| 0 467 513 A1 | 5/1991 | European Pat. Off. . |
| 2 283 963 | 5/1995 | United Kingdom . |
| WO 92/19530 | 11/1992 | WIPO . |
| WO 96/01227 | 1/1996 | WIPO . |
| 3,770,205 | 11/1973 | Proctor et al. . |
| 3,797,744 | 3/1974 | Smith . |
| 3,797,747 | 3/1974 | Buzzi et al. . |
| 3,834,596 | 9/1974 | Brady et al. . |
| 3,861,596 | 1/1975 | Nathan et al. . |
| 3,862,640 | 1/1975 | Hechler, IV . |
| 3,917,172 | 11/1975 | O'Hare . |

OTHER PUBLICATIONS

*Dispenser Pack—Smart Cartidges Offer Premium Juice*, Packaging World, A Summit Publication, vol. 3, No. 5, May 1996, 5 pgs.

*Dimensions and Tolerances for Plastic bottles*, The Plastic Bottle Institute, A Division of The Society of the Plastics Industry, Inc., Technical Bulletin PBI 2—1968, Revision 2—1978, 14 pgs.

*Cleaning Programs Made Simple*, SC Johnson & Son, Inc., 1991, 5 pp.

*3m Twist'n Full Cleaning Chemical Management System*, 3M Home and Commerical Care Division, 1993, 6 pages.

*Primary Examiner*—Henry J. Recla
*Assistant Examiner*—Steven O. Douglas
*Attorney, Agent, or Firm*—Fliesler, Dubb, Meyer & Lovejoy

[57] ABSTRACT

A distributed concentrated chemical dispensing system 300 and method include a central station 302, one or more permanently mounted satellite stations 304, and one or more portable satellite stations 306. Local concentrated chemicals can be distributed from the central station 302 without being diluted to the satellite stations 304, 306 for final dilution. An information storage device 318 is provided for tracking and keeping records of the utilization of the concentrated chemicals.

36 Claims, 18 Drawing Sheets

U.S. PATENT DOCUMENTS 4,014,363 3/1977 Hechler, IV .
4,068,681 1/1978 McNair et al. .
4,171,710 10/1979 Boynton et al. ..... 141/104
4,200,206 4/1980 Chase et al. .
4,213,796 7/1980 Shaffer .
4,218,013 8/1980 Davison .
4,298,018 11/1981 Haggard .
4,369,921 1/1983 Beiswenger et al. .
4,418,869 12/1983 Healy .
4,467,830 8/1984 Hutchinson .
4,475,689 10/1984 Hauger et al. .
4,527,740 7/1985 Gunzel, Jr. et al. .
4,653,676 3/1987 Stull .
4,683,921 8/1987 Neeser ..... 141/9
4,697,610 10/1987 Bricker et al. .
4,878,619 11/1989 Norman .
4,901,923 2/1990 McRoskey et al. .
5,007,588 4/1991 Chow et al. .
5,039,016 8/1991 Gunzel, Jr. et al. .
5,100,059 3/1992 Englhard et al. .
5,133,498 7/1992 Sealy et al. .
5,213,265 5/1993 Englhard et al. .
5,255,820 10/1993 Thomas .
5,259,557 11/1993 Spriggs et al. .
5,305,778 4/1994 Traylor .
5,320,288 6/1994 Ketcham, Jr. .
5,332,158 7/1994 Styne et al. .
5,344,074 9/1994 Spriggs et al. .
5,372,310 12/1994 Ketcham .
5,375,769 12/1994 Schultz .
5,383,603 1/1995 Englhard et al. .
5,409,146 4/1995 Hazard et al. .

DISTRIBUTED CONCENTRATED CHEMICAL DISPENSING SYSTEM

FIELD OF THE INVENTION

The present invention is directed to a method and system for distributing concentrated chemicals throughout a work site. Without limiting the scope of the invention, the concentrated chemicals can be used for maintenance purposes, such as cleaning and disinfecting, in a multiplicity of environments. Systems using other types of concentrated chemicals such as paints and epoxies are contemplated.

BACKGROUND OF THE INVENTION

A generally behind the scenes and after hours task in most commercial and industrial environments is that of maintenance of the facility through cleaning and disinfecting the surfaces and equipment found in that particular environment. Historically, such operations have been conducted through the purchase of chemicals which are of the proper concentration for the particular application along with a dispensing head, or other dispensing apparatus. Refill bottles are often available at the appropriate concentration for the before-mentioned spray heads and dispensing apparatus. The refill bottles are either directly connected to the spray heads or can be used to refill bottles which can be connected to the spray heads.

For some of the largest applications as for example found in hospitals, hotels, and other large commercial, as well as large industrial, complexes, such chemicals are purchased as highly concentrated fluids. Such highly concentrated fluids are not meant to be used directly in the particular application, but are meant to be diluted with, for example water, and then the diluted mixture used for the particular application. For such situations, the concentrated chemical fluids may be diluted at a ratio of one to ten and upwards. Normally, the concentrated chemical fluids are stored in a basement and a mechanism is provided for diluting the chemicals to the desired dilution ratio and filling the bottles which will actually be used with spray heads in order to apply the chemicals as desired. In for example a hotel, the concentrated chemicals can be stored in a basement. In the basement the concentrated chemical fluids can be diluted and used to fill literally hundreds of bottles, which can be attached to handheld spray heads for use by maintenance personnel. It can be a full-time assignment to collect, refill and redistribute these bottles and handheld spray heads.

Quite naturally, such an arrangement is highly inefficient and depending on the design can potentially expose the individual performing such task to concentrated chemical fluids. Further, in such an arrangement, large volumes of material must be redistributed from the basement to the multiplicity of work sites throughout the building.

Additionally, such systems do not offer the ability to ensure that when multiple types of chemicals are employed, that the appropriate chemicals are distributed to the appropriate work stations to be used with the appropriate spray head. Further, such systems do not have devices for recording and tracking the amount and concentration of chemical fluids which are distributed throughout the system and for example the number of times that any particular bottle is refilled.

SUMMARY OF THE INVENTION

The present invention is directed to overcoming the disadvantages of the prior art by providing a new system of distributing concentrated chemical fluids throughout a work site that is safe, convenient, and efficient and that affords record-keeping capabilities so that the usage of the concentrated chemical fluids can be monitored.

As an aspect of the present invention, the system for distributing concentrated chemical fluids includes a first central station which has a plurality of bulk storage containers for storing concentrated chemical fluids. Each of the containers has a dispensing head adapted for dispensing the concentrated chemical fluids. A plurality of delivery bottles is provided with each bottle having a filling port that allows the delivery bottle to be filled with concentrated chemical fluids from the first central station. The system further includes a plurality of satellite stations, each of said satellite stations having a first connector adapted to connect the satellite station to a source of diluting fluid. Each of the satellite stations has a second connector which allows one of the delivery bottles to be mated to a satellite station and each of the satellite stations has a mix head that is adapted to dispense a mixture of the concentrated chemical fluids and the diluting fluid. The delivery bottles associated with the particular satellite stations can be used to fill for example handheld spray applicators or buckets for larger projects.

In another aspect of the invention, the satellite stations are comprised of stations which are wall-mounted and stations which are portable.

In yet a further aspect of the invention, all the delivery bottles which are used with either the wall-mounted stations or the portable stations are identical so that they can be interchanged and also for efficiency of distribution of the concentrated chemical fluids of the system.

In a further aspect of the invention, an information storage system is provided which can determine (1) the number of times that the delivery bottles are refilled, (2) the ratios by which the concentrated chemical fluids are diluted, and (3) the amount of concentrated chemical fluids are used for any particular application. Further, the information storage system can track the bottles throughout the work site.

Such a system can be used on a large scale in hospitals, a hotel and the like with multiple floors and where many different types of operations are required. Further, such systems can also be used in single-level yet large retail department and grocery stores, as well as conventional retail outlets.

In another aspect of the invention, a method is provided for distributing concentrated chemical fluids in a working environment. This method allows the concentrated chemical fluids to be distributed throughout the work site in a safe and efficient manner, which distribution can be tracked by a information storage device. Such method ensures that the concentrated chemical fluids are not diluted until the point where such fluids must actually be applied for the intended purpose. Accordingly, the need (1) to distribute bulkier diluted chemical fluids throughout the work sites, and (2) to constantly refill spent bottles at a central location with diluted chemical fluids is avoided.

Accordingly, it is an object of the present invention to provide a concentrated chemical distribution system and method which is safe and efficient to utilize.

Another object of the present invention is to provide a system and method for concentrated chemical distribution which can track the utilization of the chemicals and the various components of the system.

It is a further object of the present invention to provide a system where delivery bottles can be filled at a central location and distributed throughout the building to be used at satellite stations, which satellite stations can be either fixed or portable.

Other aspect, objects and advantages of the invention can be obtained from a review of the specification and the figures.

DETAILED DESCRIPTION OF PREFERRED EMBODIMENT

Figure 1:
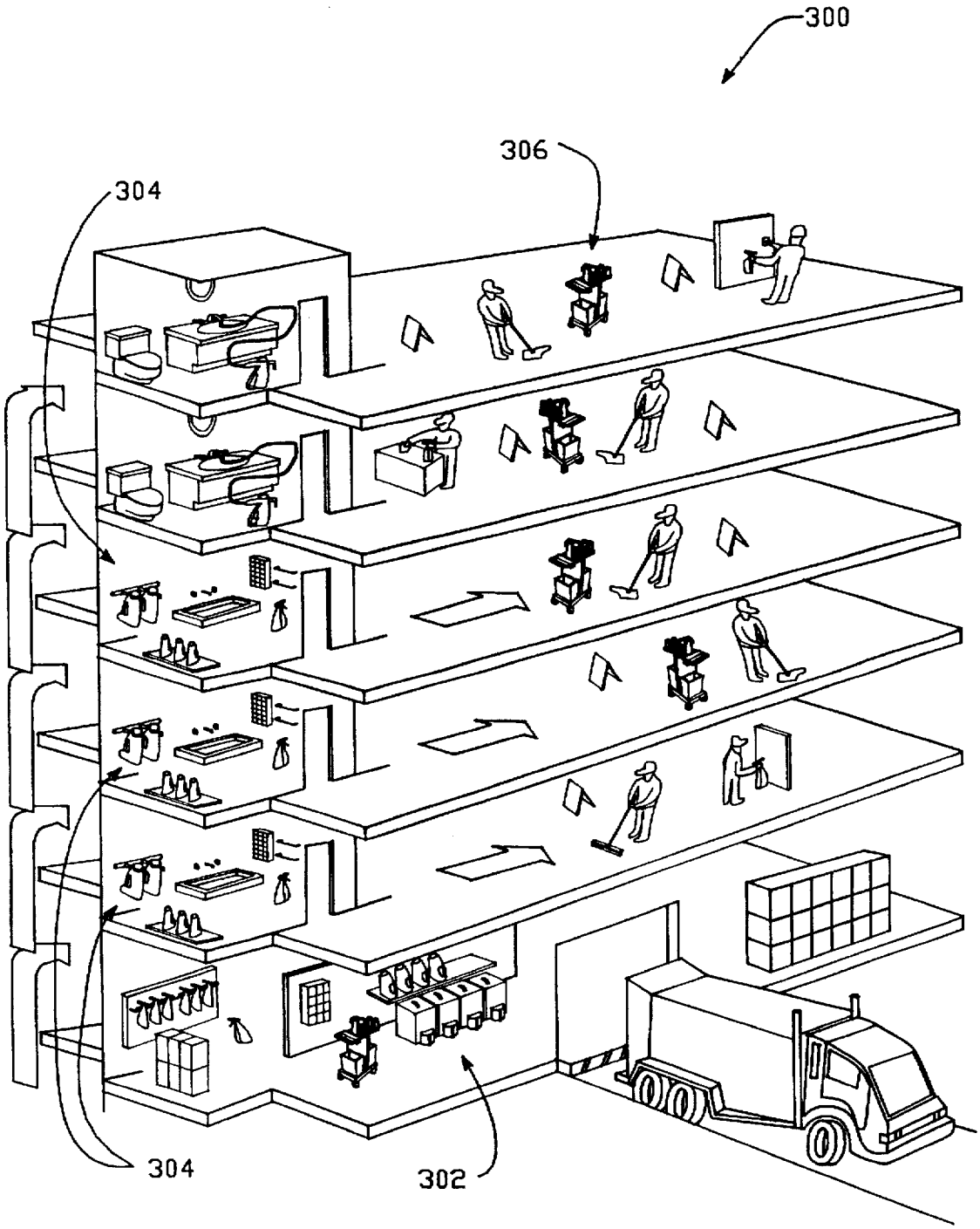
FIG. 1 depicts an embodiment of the method and system of the invention, utilization in a multi-story commercial or industrial facility.

With reference to the figures and in particular to FIG. 1, an embodiment of the distributed concentrated chemical dispensing system of the invention is depicted and identified by the number 300. System 300 includes a central station 302 and a plurality of permanently mounted satellite stations 304 and portable satellite station 306. In a multi-story building, the central station 302 would generally be located in the basement or on the first floor close to where bulk deliveries of the chemicals can be efficiently made.

Figure 3:
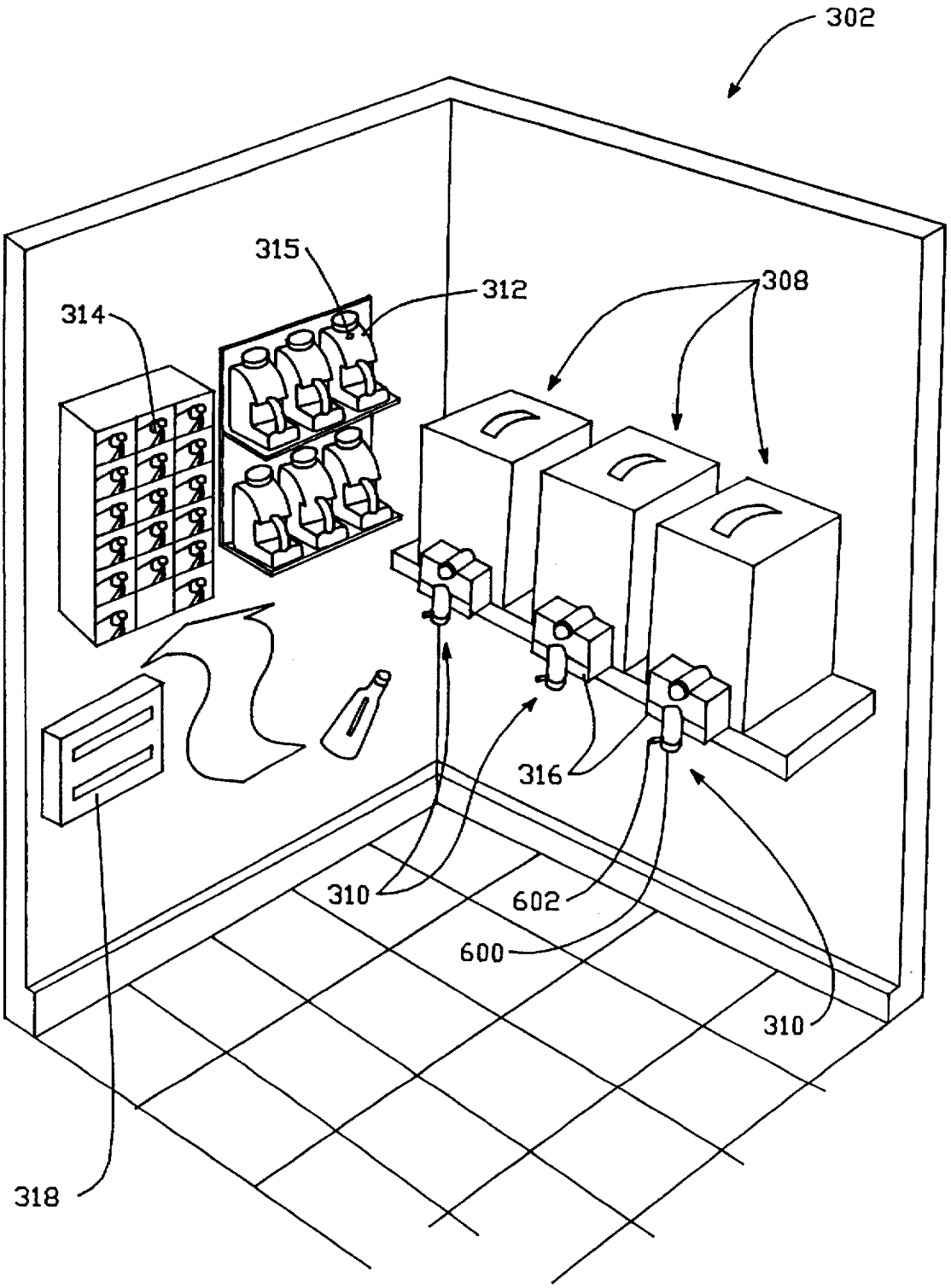
FIG. 3 depicts the central station of an embodiment of the method and system of the invention.

As can be seen in FIG. 3, the central station 302 is comprised of a plurality of bulk multi-gallon (multi-liter) containers 308 which store large amounts of the concentrated chemical fluids. One typical size would be an 18 gallon (68.1 liter) container. These containers 308 can be delivered by the supplier and fitted to a dispensing or refill head 310 which dispenses the concentrated chemical fluids as needed. Generally the dispensing heads will not dilute the concentrated chemical fluids. Also mounted in the central station 302 is a plurality of delivery bottles 312 and a plurality of spray bottles 314 for use with for example handheld sprayers for direct application of the chemical fluids to the work surfaces. The delivery bottles 312 can be of the design discussed hereinbelow with respect to FIGS. 7*a*, 7*b*, 7*c*, and 7*d* and the sprayer bottle 314 can be of the design discussed hereinbelow with respect to FIGS. 6*a* and 6*b*. However, as is evident from the figures, other designs for these bottles would be within the spirit and scope of the invention. In operation, the delivery bottles 312 and the spray bottles 314 would be filled or refilled directly from the dispensing head 310 with the concentrated chemical fluids delivered in bulk container 308. The delivery bottle 312 can have identifying indicia 315 which is read by a read head 316 (FIG. 3) associated with the dispensing head 310 or a read head 330 (FIG. 4) associated with a satellite station. FIGS. 7*a*, 7*b*, 7*c*, and 7*d* (which have a somewhat different bottle shape than that depicted in FIGS. 4 and 5, but which otherwise functions the same) as described below, depict further read and write operations which can be used for the gathering and storage of data with respect to the utilization of system 300. An information storage device 318 is also part of the central station 302. Information storage device 318 can include a lap top or a portable computer, a desktop computer or a mainframe. Information storage device 318 can monitor the use, distribution of concentrated chemical fluids and the use, distribution and refill rate of the delivery bottle 312 through the indicia marked thereon, and also the spray bottles 314 if it is desired to have identifying indicia placed on these bottles.

Figure 4:
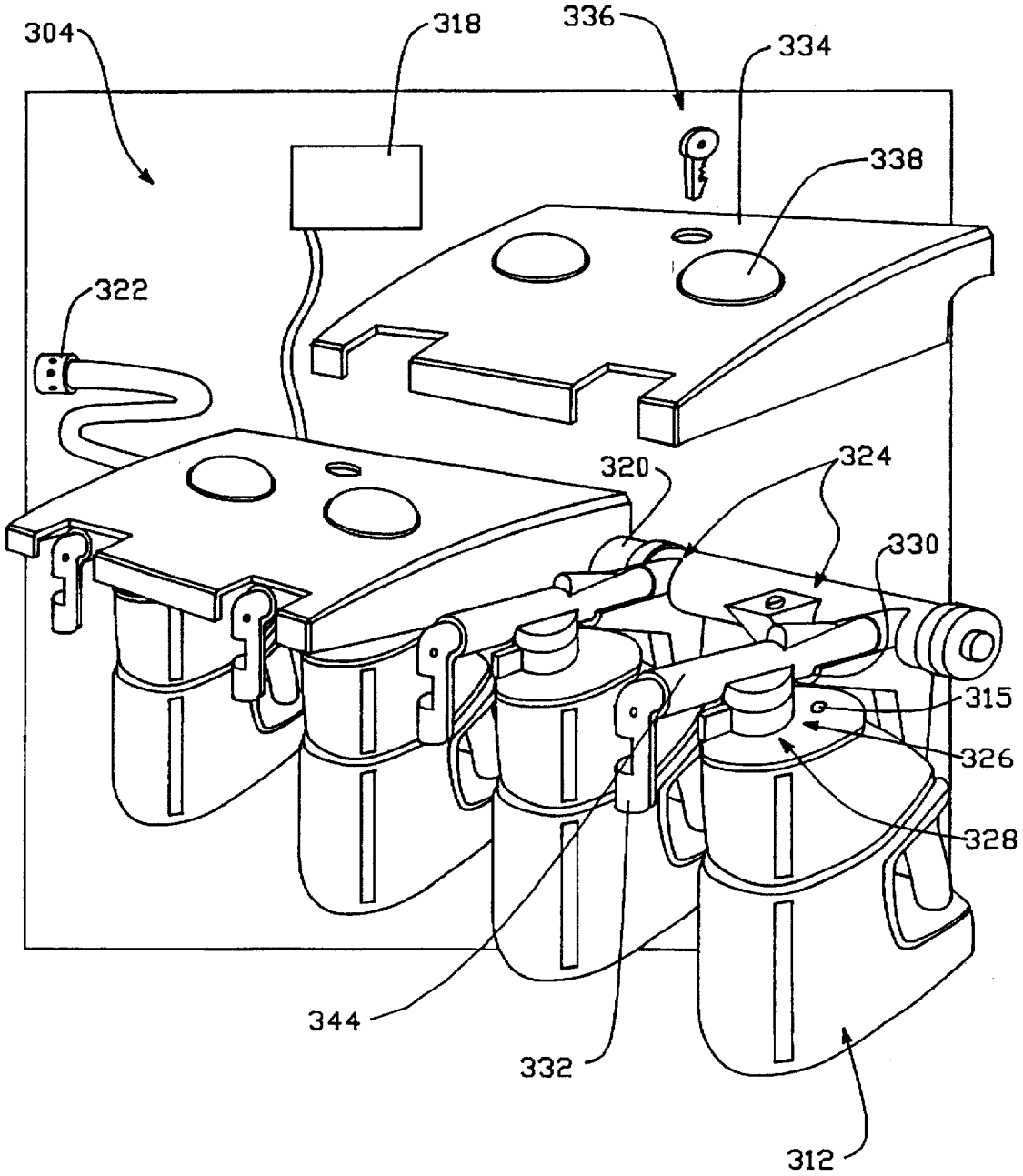
FIG. 4 depicts a wall-mounted satellite station of an embodiment of the method and system of the invention.

As can be seen in FIG. 1, the satellite stations 304 are located throughout the building and on various floors of the building. A first permanently mounted satellite station 304 as seen in FIG. 1 and as seen in FIG. 4 include a wall-mounted manifold arrangement 320 which can be connected to a source of diluting fluids such as the public water supply through a connector 322. As discussed more fully with respect to FIGS. 7*a*, 7*b*, 7*c*, and 7*d*, mix heads 324 (FIG. 4) are secured to and communicate with the mainfold 320. In FIG. 4, four side-by-side mix heads 324 are depicted. It is to be understood that as few as one and certainly many more than four mix heads can be mounted in such a permanent satellite station 304. Through a mix head interconnect mechanism 326 and a corresponding bottle interconnect mechanism 328, the delivery bottles 312 can be joined to the mix head 324 with all the mechanisms and advantages as described with respect to FIGS. 7*a*, 7*b*, 7*c*, and 7*d*. The mix heads 324 include an indicia reader 330 which can read indicia 315 on the delivery bottles 312 and also write to storage devices on the bottles. The indicia readers 330 are connected to, or can be made to download information to, the information storage system 318 (FIG. 3). The mix heads 324 include a dispensing nozzle 332 which can dispense a mixture of the concentrated chemical fluids and the diluting fluid. A protective cover 334 can be secured with a lock and key arrangement 336 in order to prevent tampering with the satellite stations. Buttons 338 are provided through the cover 334. Pressing of these buttons causes the correctly proportioned mixture to be dispensed from the dispensing nozzle 332 into a bucket, or conventional handheld spray applicator, or some other conventional application device.

The arrangement of FIG. 4 can be set up so that each mix head 324 can dispense a different chemical fluid or that each mix head 324 dispenses a different mix ratio of the same chemical fluid or a combination of both.

Figure 5:
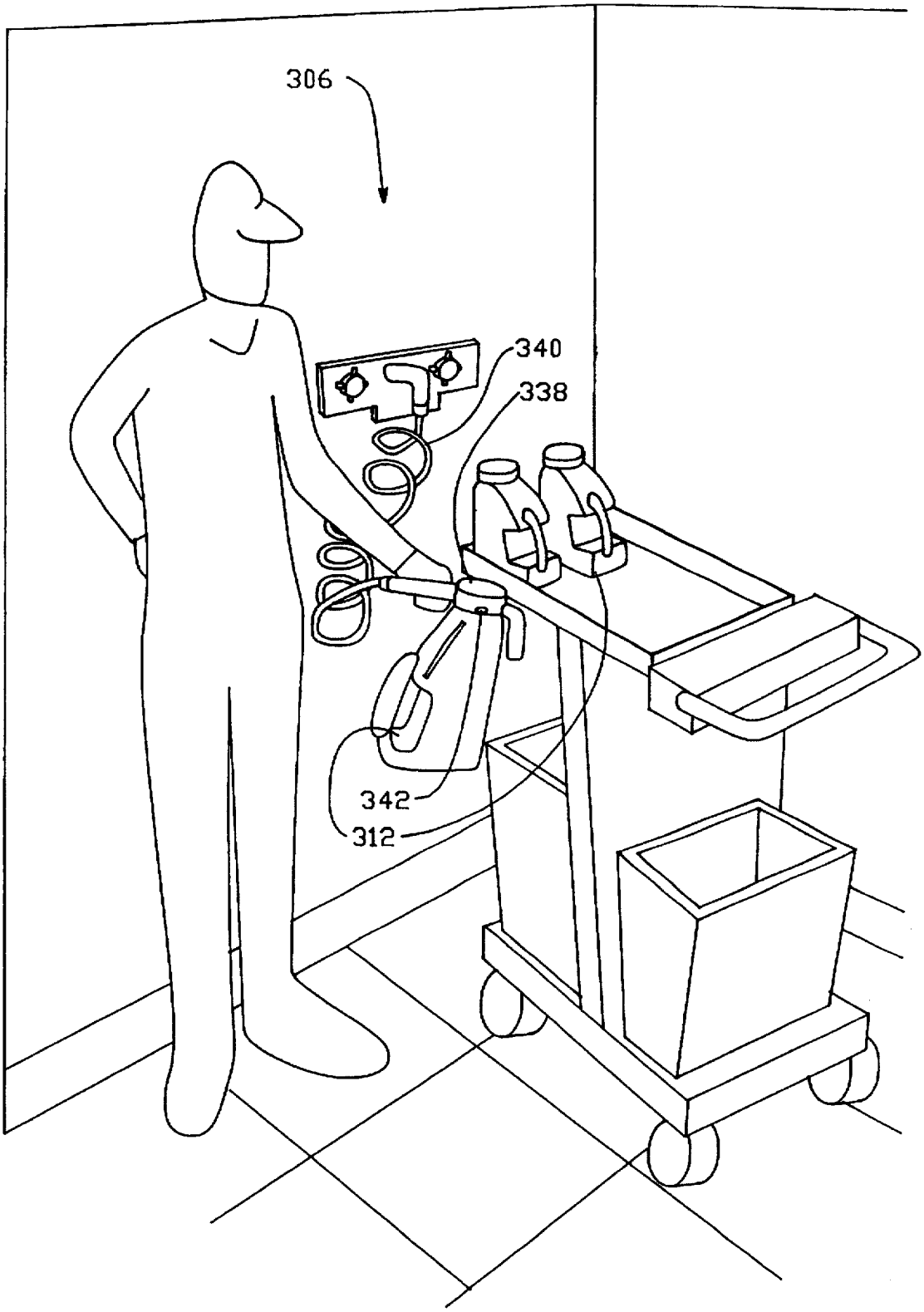
FIG. 5 depicts a portable satellite station of an embodiment of the method and system of the invention.

FIG. 5 depicts a portable satellite station 306. This satellite station 306 includes a portable mix head 338 similar in design and function as mix head 324 except that it can be handheld and carried to the work site. The portable mix head 338 can be connected to a source of diluting fluid such as the public water supply through a flexible conduit 340. As with the operation of the mix head and delivery bottle of FIG. 4 and additionally FIGS. 7*a*, 7*b*, 7*c*, and 7*d*, an operator can cause a mixture of concentrated chemicals and diluting solution to be dispensed for purposes of applying as required.

Further if desired, the portable mix head 338 can include an onboard indicia reader 342 which is preferably battery powered and self-contained and which can read data from the delivery bottle 312 and write to a programmable strip on the dispensing bottle as described with respect to FIGS. 4, 7*a*, 7*b*, 7*c*, and 7*d*. At a later time, the information stored in the indicia reader 342 and the dispensing head 338 can be downloaded to a information storage device 318, such as described with respect to the central station 302.

Figure 6B:
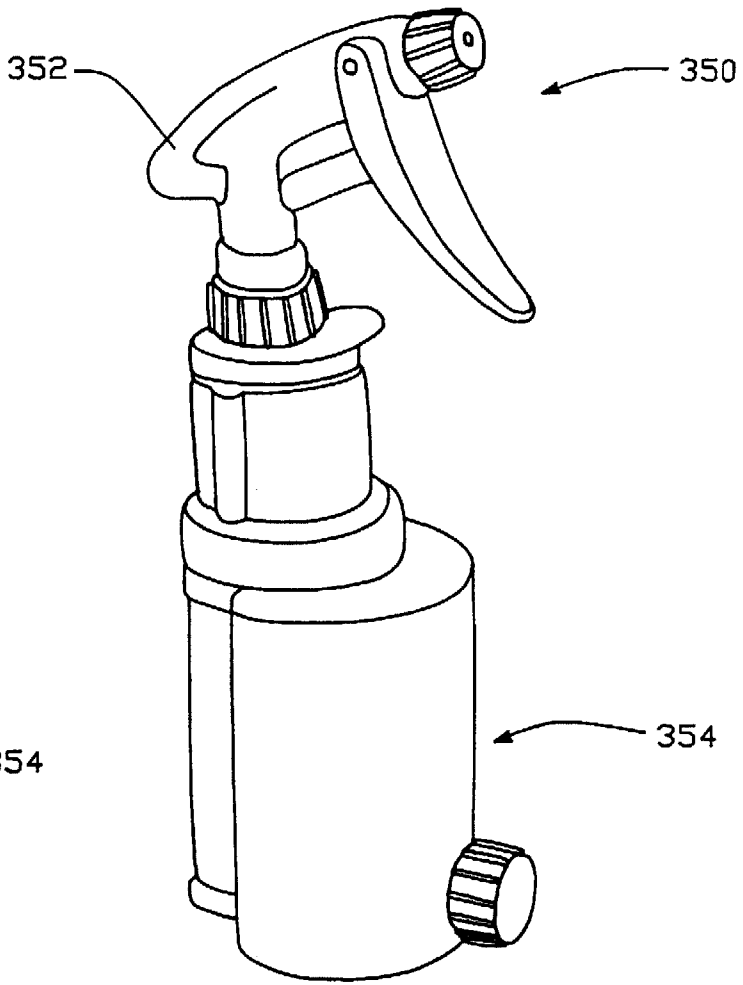
FIG. 6*a* and 6*b* depict a handheld sprayer which can be used as part of the method and system of the invention.
Figure 6A:
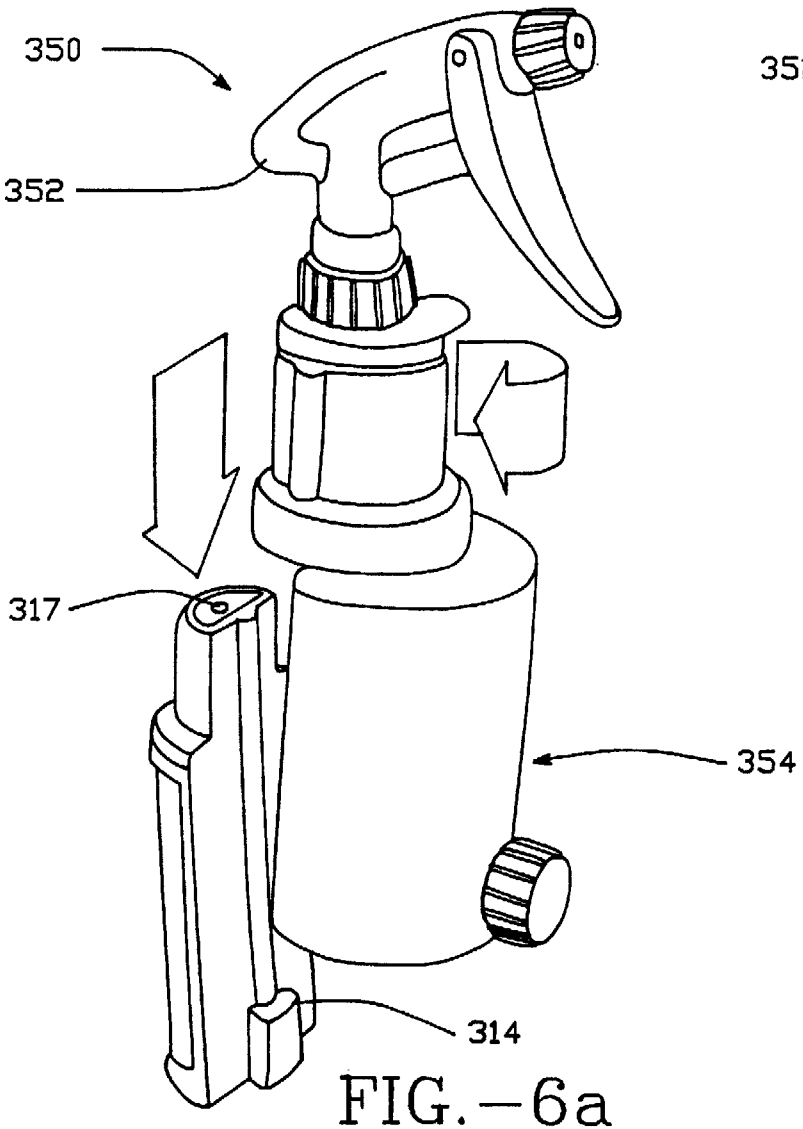

FIGS. 6*a* and 6*b* depict a handheld sprayer 350 which includes a handheld pump type spray head 352 and a vessel 354 which contains diluting fluid such as water. Securable to the sprayer head 352 is the spray bottle 314 which can be filled with the concentrated chemical fluids is as described hereinabove with respect to FIG. 3. The action of the spray head 352 causes the water in container 354 and the concentrated chemical fluids in spray bottle 314 to be drawn up, mixed, and dispensed therefrom at the work site. The port 317 of bottle 314 is adapted to mate with concentrate dispensing head 310 (FIG. 3).

It is to be understood that a conventional one reservoir handheld sprayer (not shown) can be used with this invention. With such a conventional sprayer, the reservoir is filled with a appropriately pre-diluted fluid comprised of a mixture of diluting fluid and concentrated fluid. Such a pre-diluted fluid could be dispersed from for example satellite station 304 (FIG. 4).

FIGS. 7*a*, 7*b*, 7*c*, and 7*d* depict a mix head and bottle arrangement which preferably is used with the system as disclosed hereinabove. However, other designs for such mix head and bottle arrangement can be made and come within the spirit and scope of the invention. With respect to FIGS. 7*a*, 7*b*, 7*c* and 7*d*, the following description applies.

Figure 7A:
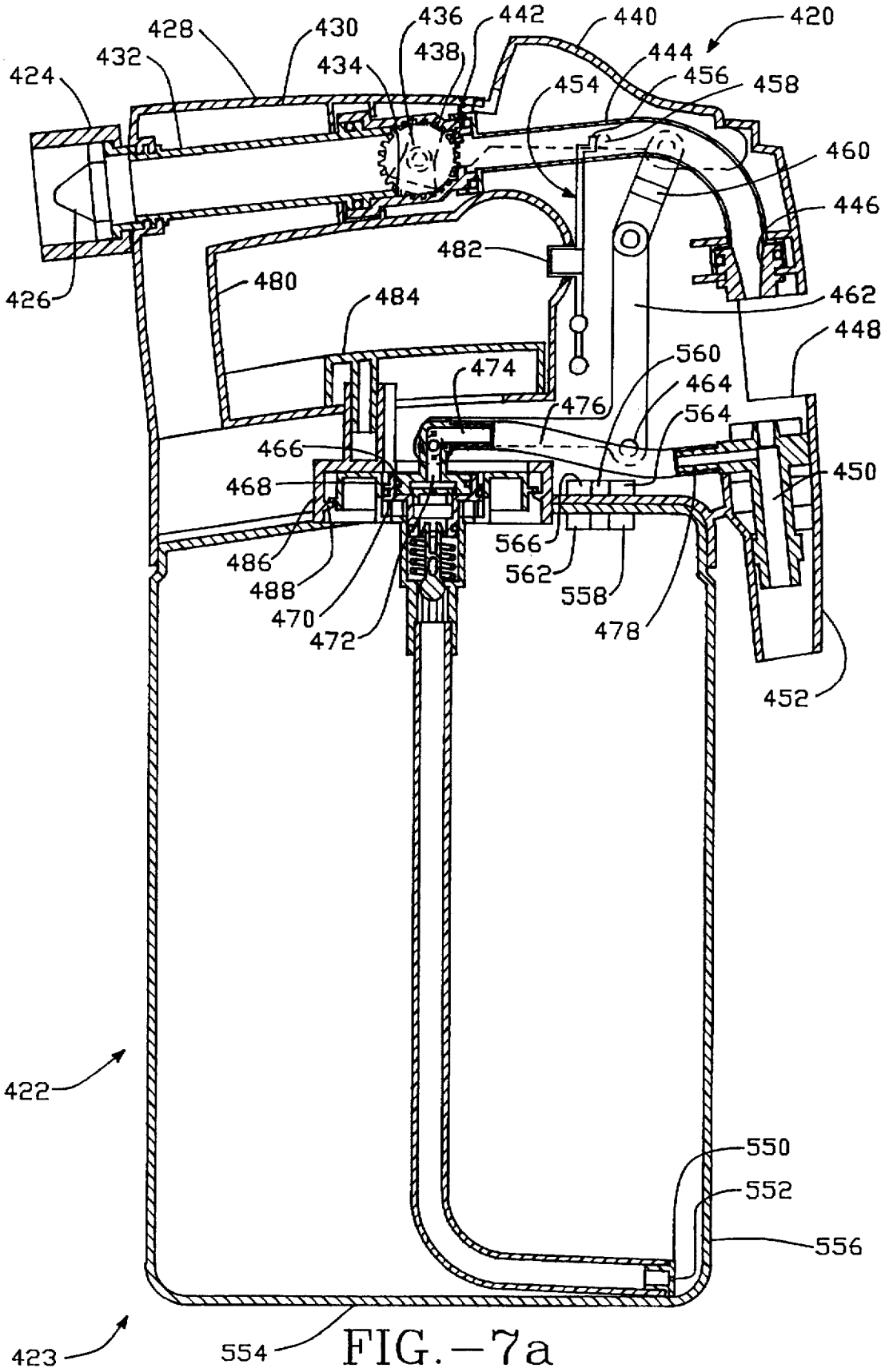
FIG. 7*a*, 7*b*, 7*c* and 7*d* depict an embodiment of a mix head and delivery bottle system which can be used as part of the method and system of the invention.
Figure 7B:
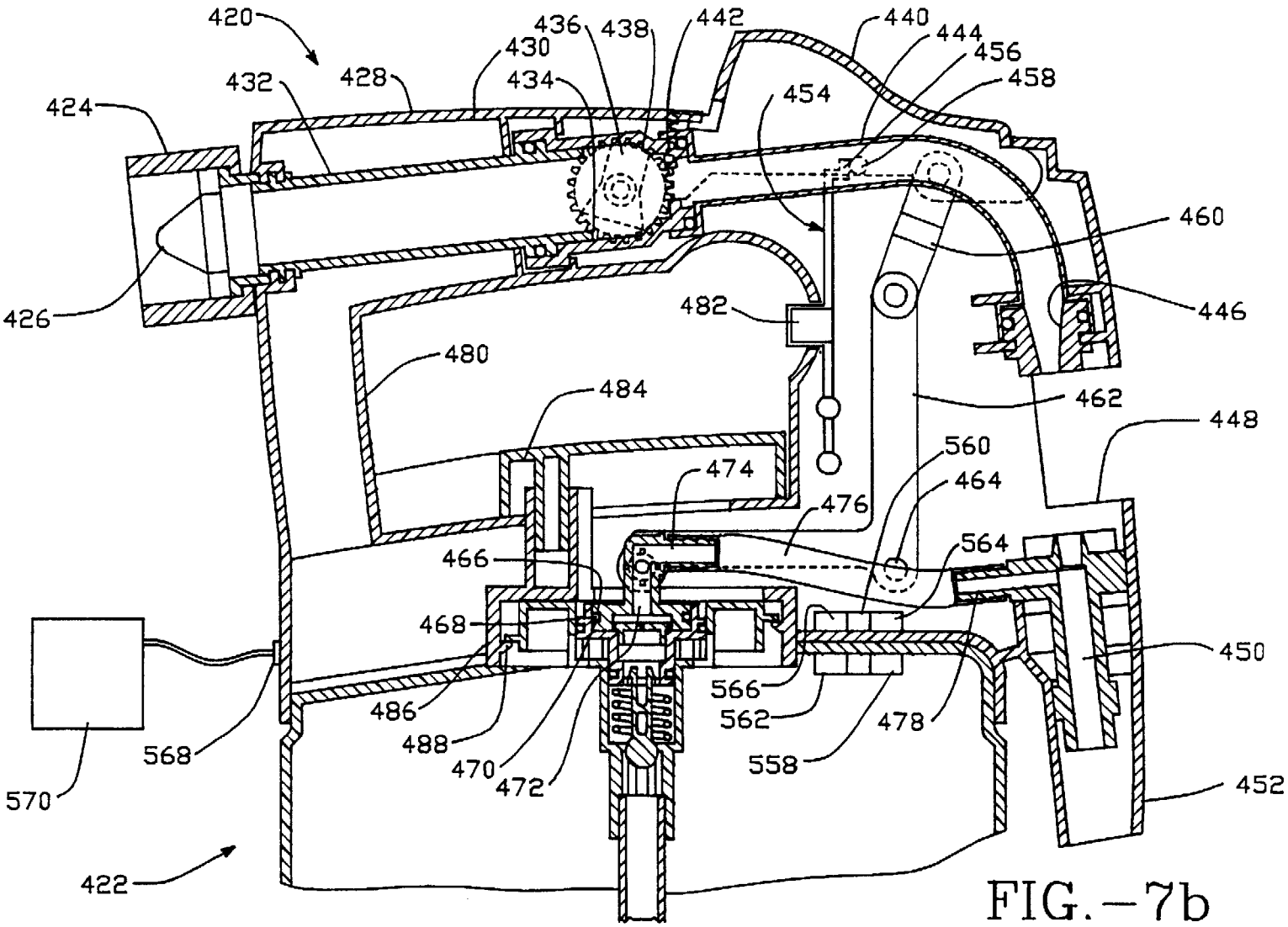

In FIGS. 7*a*, 7*b*, an embodiment of a mix head or filling head 420 and bottle 422 of the system 300 of the invention is depicted. The mix or filling head 420 is meant to be portable and connected to a source of water through a flexible conduit such as a hose (similar to the embodiment in FIG. 5). It is to be understood that with minor changes the embodiment of FIGS. 7*a*, 7*b*, 7*c*, and 7*d* could be permanently mounted to a wall or as shown in FIG. 4. Accordingly, the embodiment of filling head 422 includes a hose connector 424 with a filter screen 426. Hose connector 424 is mounted to the handle 428 of the filling head 420. Handle 428 includes a housing 430 which encases a swivel fitting 432 which connects the hose connector 424 to a valve housing 434 which houses a ball valve 436. A valve pinion 438 is used to cause the ball valve 436 to open and close. The filling head 420 includes a trigger 440 which is pivotally mounted to the housing 430. Trigger 440 includes a rack 442 which operatively engages the valve pinion 438. Accordingly, as the trigger is depressed, the rack 442 causes the valve pinion 438 and the ball valve 436 to rotate about its axis opening the valve to allow a source of fluid, preferably water, enter fluid supply tube 444. From fluid supply tube 444 the water is directed by a nozzle 446 through an air gap 448 to an eductor 450 and is dispensed through filling nozzle 452. As the source of diluting fluids such as water must go through eductor 450 prior to the eductor generating sufficient vacuum to draw a concentrated chemical from the bottle 422, the filling head 420 will not dispense concentrated chemicals without first diluting them with an appropriate ratio of water.

An eductor suitable for use as eductor 450 is disclosed in U.S. Patent Application entitled MIX HEAD EDUCTOR filed on Jan. 19, 1996, and given U.S. patent application Ser. No. 08/588,802. The application lists Michael J. Greaney as the inventor. This application has been assigned to the present assignee. Other types of eductors can also be used with the system disclosed herein.

The filling head 420 further includes a trigger lock mechanism 454 which can lock the trigger with the ball valve 436 in the open position by causing leg 456 of the trigger lock mechanism 454 to engage and hold down pin 458 of the trigger 440. Button 482 operates the trigger lock mechanism 454.

Simultaneously with the opening of ball valve 436, the trigger mechanism causes the fluid and vent ports of the bottle 422 to be opened so that concentrated chemicals in the bottle can be drawn up by the eductor 450 and mixed with the diluting fluid in eductor 450 in a manner as described below.

Trigger 440 is pivotally connected to a small link 460 which is pivotally connected to a bell crank 462. Bell crank 462 is pinned about pivot point 464. Pivotally connected to bell crank 462 is a actuator or plunger 466. Plunger 466 is substantially circular in shape and includes an elastomeric 0-ring 468 retained in a peripheral groove 470. Plunger 466 includes a recessed cavity 472 which is cylindrical in shape and centrally located within said plunger 468. The recessed cavity 472 communicates with an elbow connector 474. Connected to the elbow connector 474 is a flexible conduit 476. Flexible conduit 476 is additionally secured to inlet port 478 of eductor 450 in order to provide concentrated chemicals to eductor 450.

Within the filing head 420 is an internal user hand engagement space 480. In this engagement space 480, the button 482 is located which operates the trigger lock mechanism 454. Also within this hand engagement space 480 is a quarter turn locking handle 484. This locking handle 484 is operatively secured to a filling head interconnect mechanism 486, which mechanism is disposed about and also comprises the plunger or actuator 466. The interconnect mechanism 486 includes a quarter turn thread 488 which engages the bottle 422 as will be described hereinbelow.

Figure 7C:
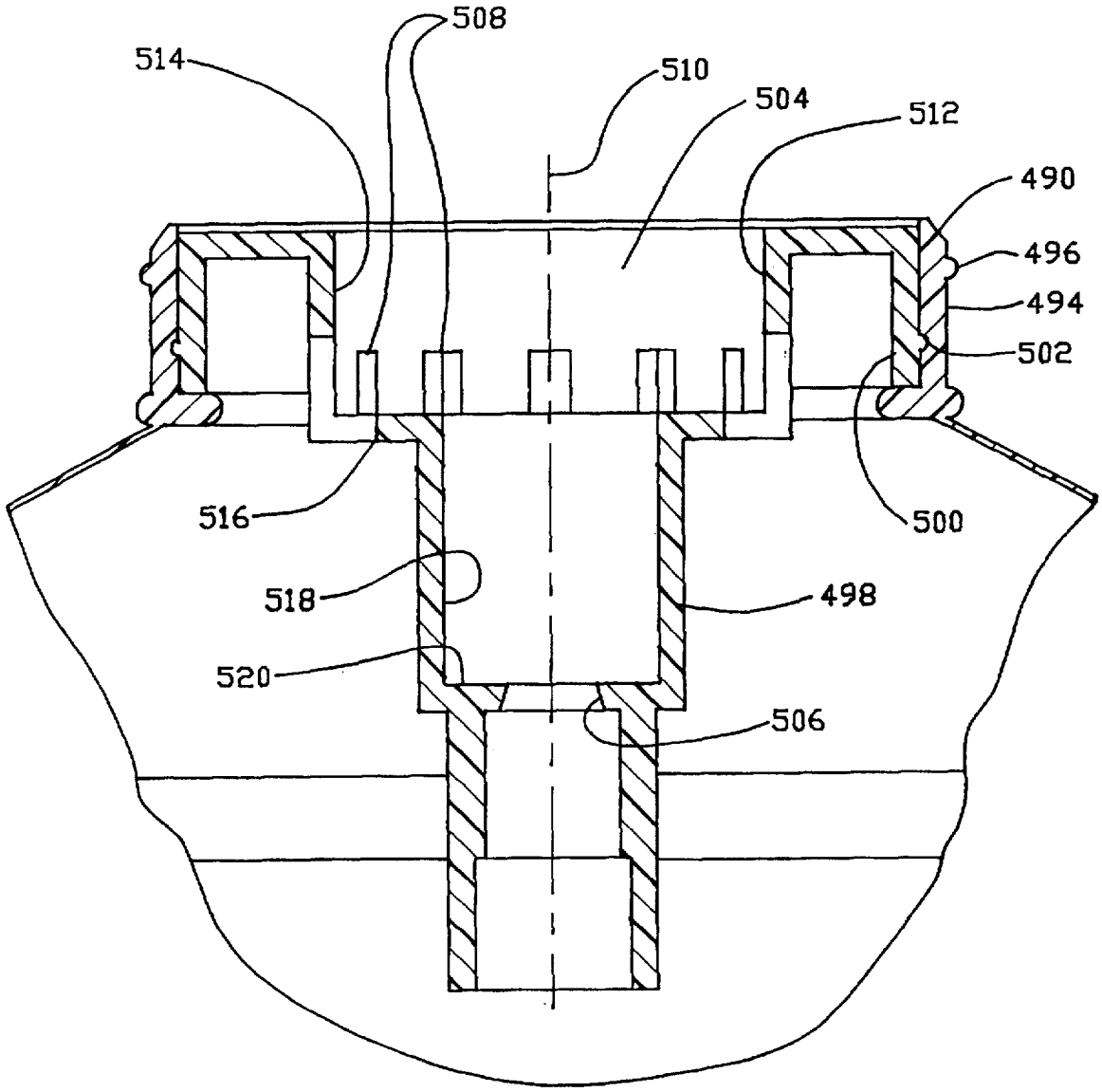
Figure 7D:
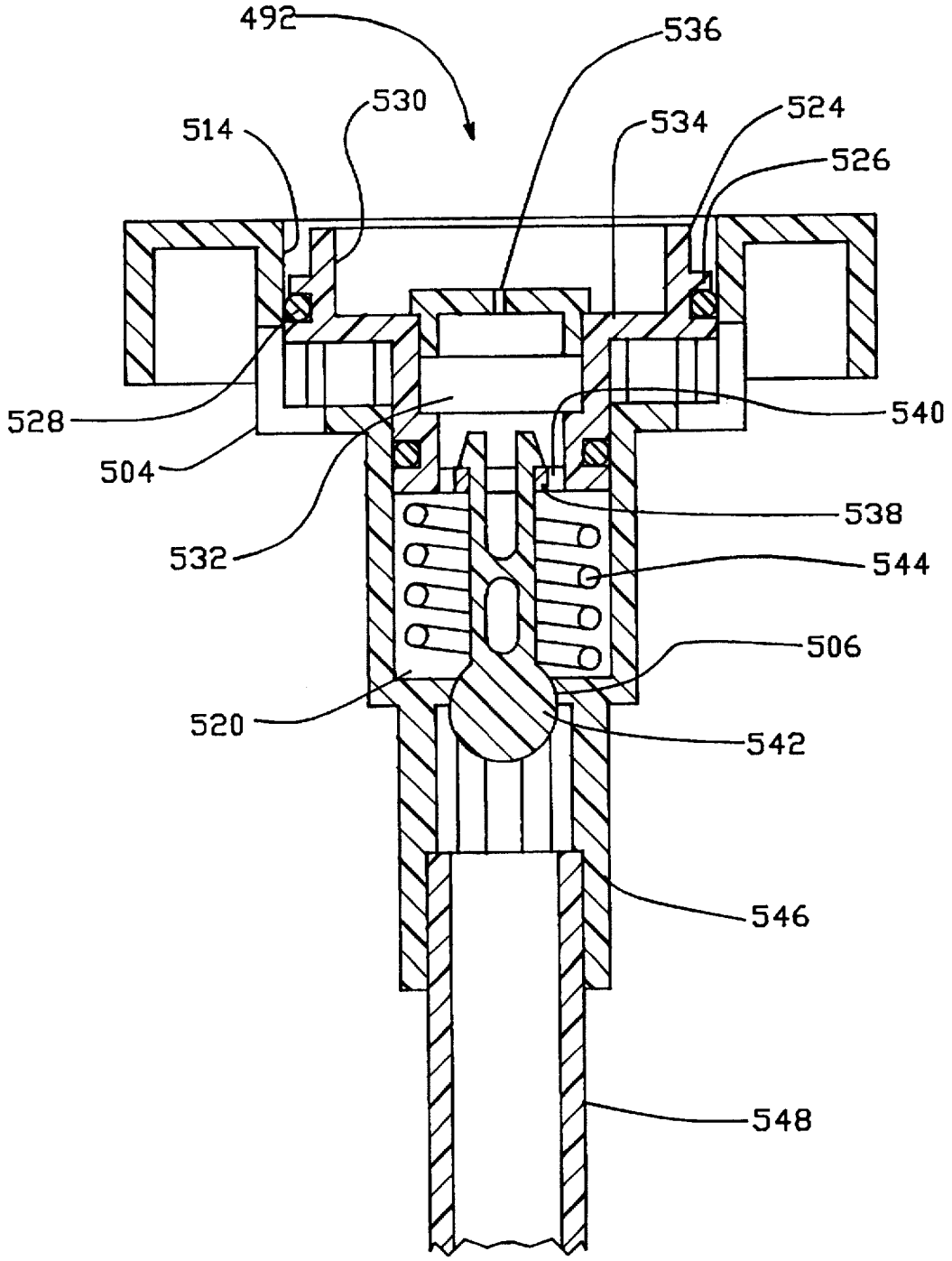

An embodiment of the bottle 422 of the invention can be seen in greater detail collectively in FIGS. 7*c*, 7*d*. FIG. 7*c* shows an enlargement of the bottle interconnect mechanism 490 without a valve mechanism 492. The bottle interconnect mechanism 490 includes an upstanding collar 494 which has defined thereon a quarter turn thread 496 which is compatible and mates with the quarter turn thread 488 (FIG. 7*a*) of the fill head interconnect mechanism 486. A valve housing insert 498 is received inside of upstanding collar 494. The valve housing insert 498 includes a peripheral collar 500 which can snap into the upstanding collar 494 through the use of a detent arrangement 502. The valve housing insert 498 includes a vent port 504 and a fluid port 506. The vent port 504 includes a plurality of individual vent ports 508 which are L-shaped in cross-section and which radiate outwardly from a central axis 510. In a preferred embodiment, the individual vent ports 508 are located equally spaced about the first cylindrical cavity 51 2 of the valve housing insert 498. The individual vent ports 508, being L-shaped, are defined both on the peripheral walls 514 of the first cylindrical cavity 502 and also in the base 516 of the first cylindrical cavity 512.

Located immediately below the first cylindrical cavity is a second cylindrical cavity 518 which is concentric about the axis 510. This second cylindrical cavity 518 defines in its base 520 the fluid port 506. Fluid port 506 has a curved wall that is designed to accept a ball valve as more fully described below.

In FIG. 7*d*, the valve mechanism 492 of the bottle is presented. The valve mechanism 492 is positioned in a first position to close off the vent port 504 and the fluid port 506. The valve mechanism 492 is depressed in order to open up the vent port 504 and the fluid port 506. In actual operation, the movement of the valve mechanism 492 is accomplished by the movement of the plunger 466 of the filling head 422 from a first to a second position as the trigger 440 of the filling head 420 is depressed.

The valve mechanism 492 includes a valve plunger 524 which is substantially cylindrical in shape and is received in the first cylindrical cavity 512 of the valve housing insert 498. The valve plunger 524 includes a peripheral groove 526 which receives an O-ring 528. O-ring 528 rubs against and creates a seal with peripheral wall 514 in order to selectively seal off or open the vent port 504. Valve plunger 524 has a first cylindrical cavity 530 and a second cylindrical cavity 532. At the base 534 of the first cylindrical cavity 530, a metering orifice 536 is positioned. This metering orifice can be omitted or changed in order to adjust the dilution ratio of the filling head 420 and bottle 422 and still be within the spirit and scope of the invention. At the base 538 of a second cylindrical cavity 532 a plurality of passages 540 are provided for allowing the concentrated chemicals to pass. Secured to the base 538 is a ball 542 which can selectively seat against the fluid port 506 in order to open or close the fluid port 506. A valve spring 544 is contained within the second cylindrical cavity 518 of the valve housing insert 498 and is biased between the base 520 of the second cylindrical cavity 518 and the base 538 of the second cylindrical cavity 532 of the valve plunger 524. An insert collar 546 extends from the base 520 of the second cylindrical cavity 518 of the valve housing insert 498. Fitted into collar 546 is a concentrated chemical pick-up tube 548 which at its distal end 550 includes a metering orifice 552 (FIG. 7*a*). In a preferred embodiment, the distal end 550 and the metering orifice 552 are disposed on the base 554 of the bottle 422 adjacent to the front wall 556 of the bottle 422. As the bottle is meant to tilt at about a 5° angle forwardly relative to the filling head 422, whether the filling head 422 is permanently mounted to a wall or handheld, the position of the metering orifice 552 adjacent the front wall 556 allows the filling head 422 to remove substantially all of the concentrated chemicals in the bottle, while leaving only a very small residual amount.

In an alternative embodiment, the spring 544 which biases the ball 542 to a closed position can be placed elsewhere, as for example, in the filling head 420 in order to perform a like function. Further, in an alternative embodiment, the metering orifice 550 can be removed.

As can be seen in FIG. 7*b*, the plunger 466 of the filling head 420 engages the valve plunger 524 of the bottle 422 with the plunger 466 fitting into and pushing against the first cylindrical cavity 530 of the valve plunger 524. The recessed cavity 472 of the plunger 466 fits over and receives the head of the metering orifice 536 which is fitted in the valve plunger 524. With the trigger 440 depressed, the plunger 466 urges the valve plunger 524 downwardly to a second position wherein the valve plunger 524 opens both the vent port 504 and the fluid port 506 simultaneously. If at any time the filling head 420 becomes removed from the bottle 422, both of these ports 504, 506 instantaneously close as the spring 544 (FIG. 7*d*) urges the valve plunger 524 to the first closed position preventing any spillage of concentrated chemicals from the bottle 422.

The bottle 422 further includes identifying indicia 558 (FIG. 7*b*) which in a preferred embodiment can include any one or a combination of optical encoded indicia, magnetically encoded indicia, electrically conductive encoded indicia, or 3-dimensional encoded indicia, or other identifying indicia as may be used in the trade. The filling head 420 includes a reading device 560 which can selectively read indicia 558. It is to be understood that the indicia 558 can include a programmable storage device or strip 562 such as a magnetic or optical strip which can preferably be one time or multiple times writable. The filling head 420 can further include a writing head 564 which can write to the programmable strip 562. The reading device 560 can be associated with an internal information storage device 566 which can store information gathered from the indicia 558. The filling head 420 can also include an external communication jack 568 which can be connected as desired to a remote information storage device such as for example a portable computer 570. Finally, it is noted that dispensing head 310 can fill bottle 422, and that the readers 316 and 330 can read the indicia on the bottle 422.

The dispensing or refill head 310 of the central station 302 (FIG. 3) can include in a preferred embodiment a dispensing or refill head plunger 600 (FIGS. 3, 8*a*, 8*b*, and 8*c*). Refill head plunger 600 can be moved in and out of engagement with the delivery bottles 312, 422 for purposes of filling same. In one embodiment, a quarter turn of lever 602 (FIG. 3), locks the delivery bottle 312, 422 (FIG. 4) to the head 310 containing refill head plunger 600 much the same way that a quarter turn of locking handle 484 (FIG. 7*a*) locks the delivery bottle 422 to the filling head 420 of FIG. 7*a*. Alternatively, the plunger 600 can be stationary with the bottle 312, 422 urged against the plunger 600 in order to refill the bottle using the same procedures as outlined below with respect to FIGS. 8*f* and 8*g*.

Figure 8A:
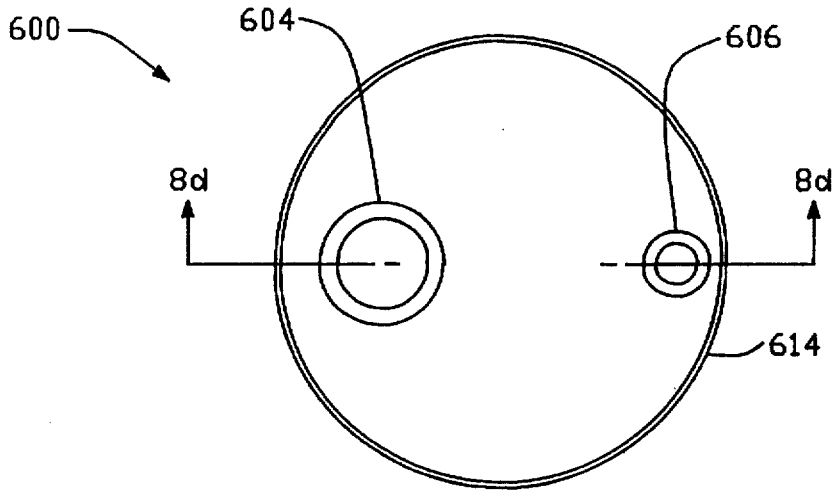
FIGS. 8*a*, 8*b*, and 8*c* depict top, side and bottom views of an embodiment of a dispensing or refill head which can be used at the central station of FIG. 3 to refill the delivery bottles as depicted in FIGS. 4, 5, 7*a*, and 7*b*.
Figure 8B:
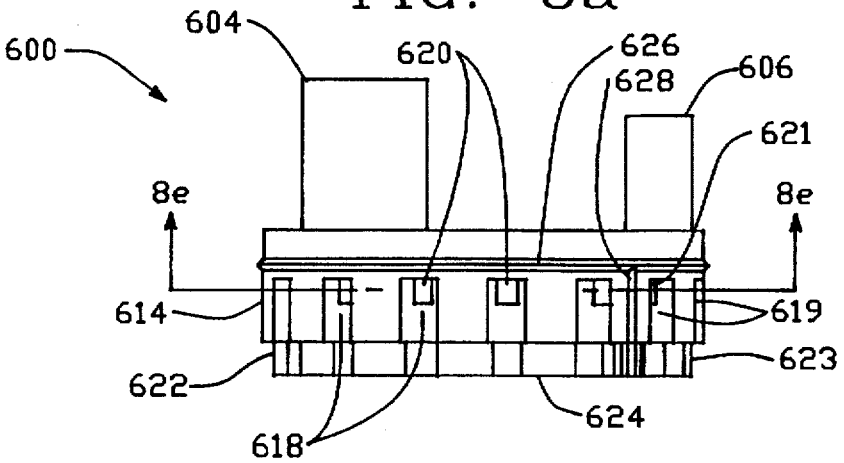
Figure 8C:
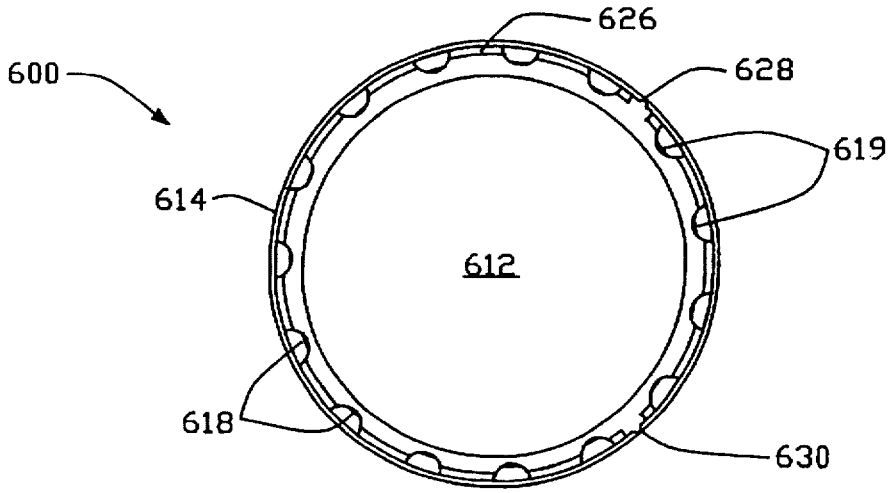
Figure 8D:
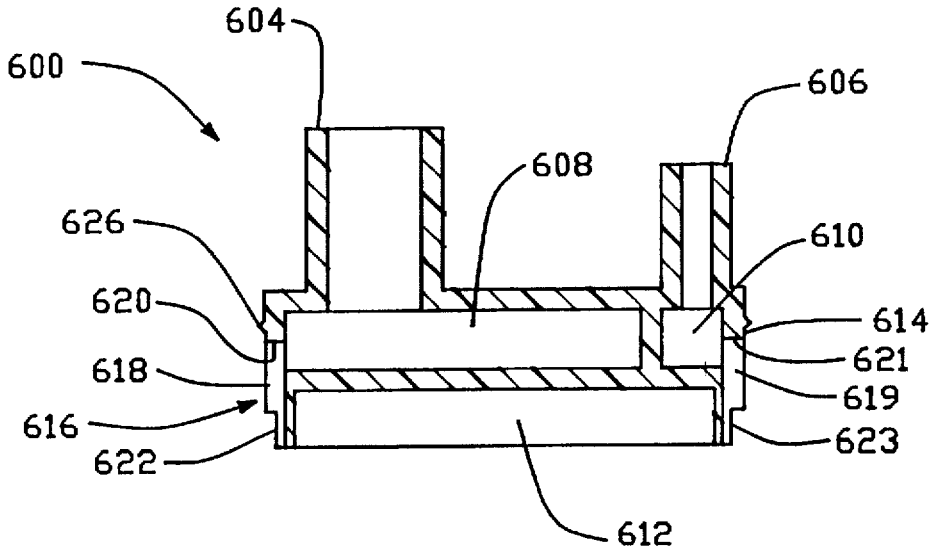
FIG. 8*d* is a cross-sectioned view taken through FIG. 8*a*—8*a*.
Figure 8E:
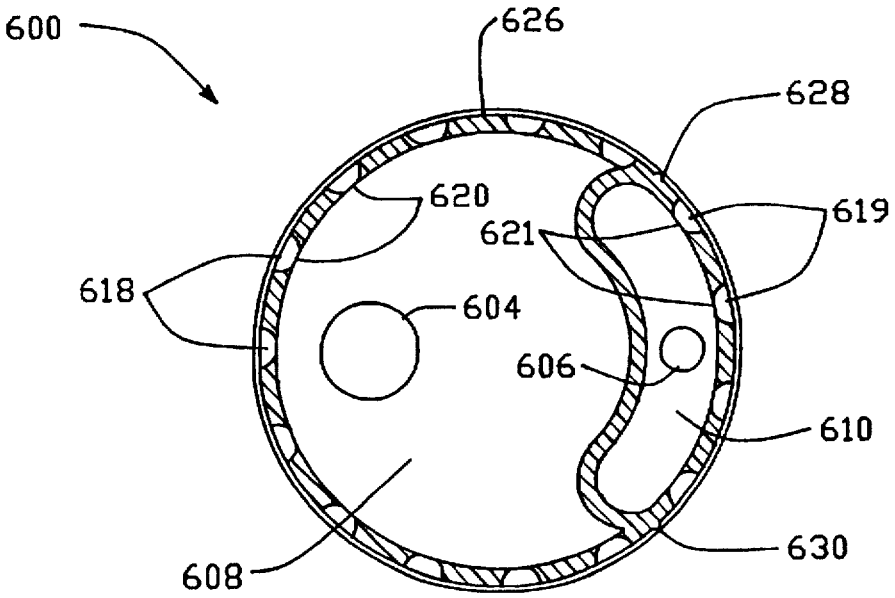
FIG. 8*e* is a cross-sectioned view taken through FIG. 8*b*—8*b*.

FIGS. 8*a*, 8*b*, and 8*c* depict the top, side, and bottom view of the refill head plunger 600. As can be seen in FIGS. 8*a* and 8*b*, the plunger 600 includes a concentrate inlet port 604 and an air vent 606. The concentrate inlet port 606 (FIGS. 8*d* and 8*e*) communicates with a internal plenum 608. The air vent 606 communicates with an internal plenum 610. Below plenums 608, 610 is a recess 612 defined by a downwardly dependent peripheral wall 614. Recess 612 is adapted to mate with a valve plunger 524 (FIG. 7*d*) as will be more fully described with respect to FIGS. 8*f* and 8*g*. The peripheral wall 614 describes a right circular cylinder with a peripheral external surface 616. Described on the external surface 616 are a first plurality of semi-cylindrical or scalloped recesses 618 and a second plurality of semi-cylindrical or scalloped recess 619 (FIG. 8*e*). Recesses 618 communicate through a plurality of ports 620 with the internal plenum 608 and recess 619 communicates through a plurality of ports 621 with the internal plenum 610. FIGS. 8*b*, 8*c*, and 8*d*, the external surface 616 includes first and second peripheral indentations 622, 623 which are located at the bottom 624 of the external surface 616. First indentation 622 communicates with all of the recesses 618 which in turn communicate with the internal plenum 608. Second peripheral indentation 623 communicates with the recesses 619 which communicate with the internal plenum 610. Plunger 600 includes a first sealing gasket 626 which is located circumferentially about the external surface 616, and second and third sealing gaskets 628, 630 which are downwardly dependent from gasket 626 and which confines the scalloped recess 619 which provides for the venting of air.

Figure 8F:
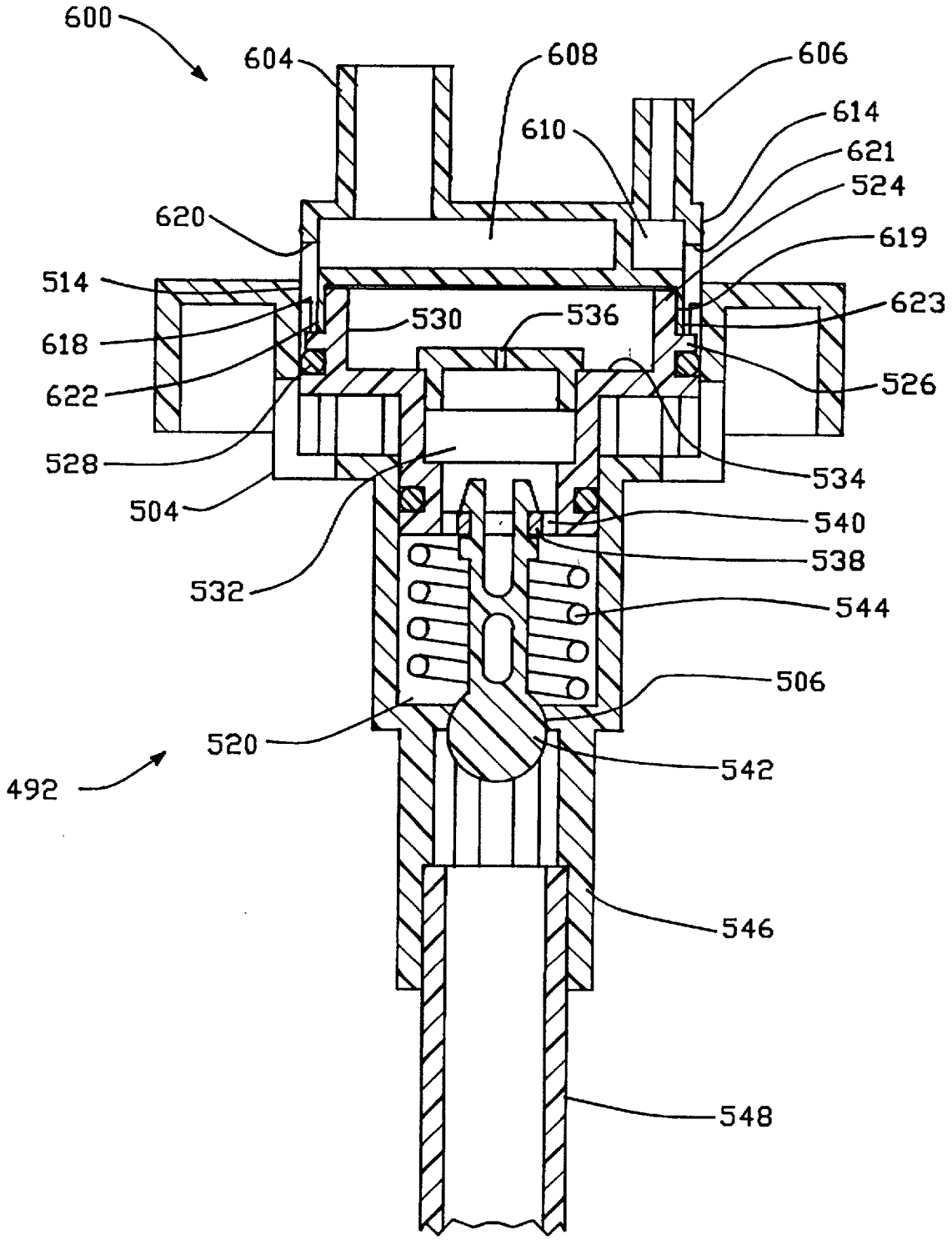
FIG. 8*f* is a cross-sectioned view of the refill head shown in FIG. 8*d*, positioned above a valve mechanism, similar to the valve mechanism shown in FIG. 7*d*.
Figure 8G:
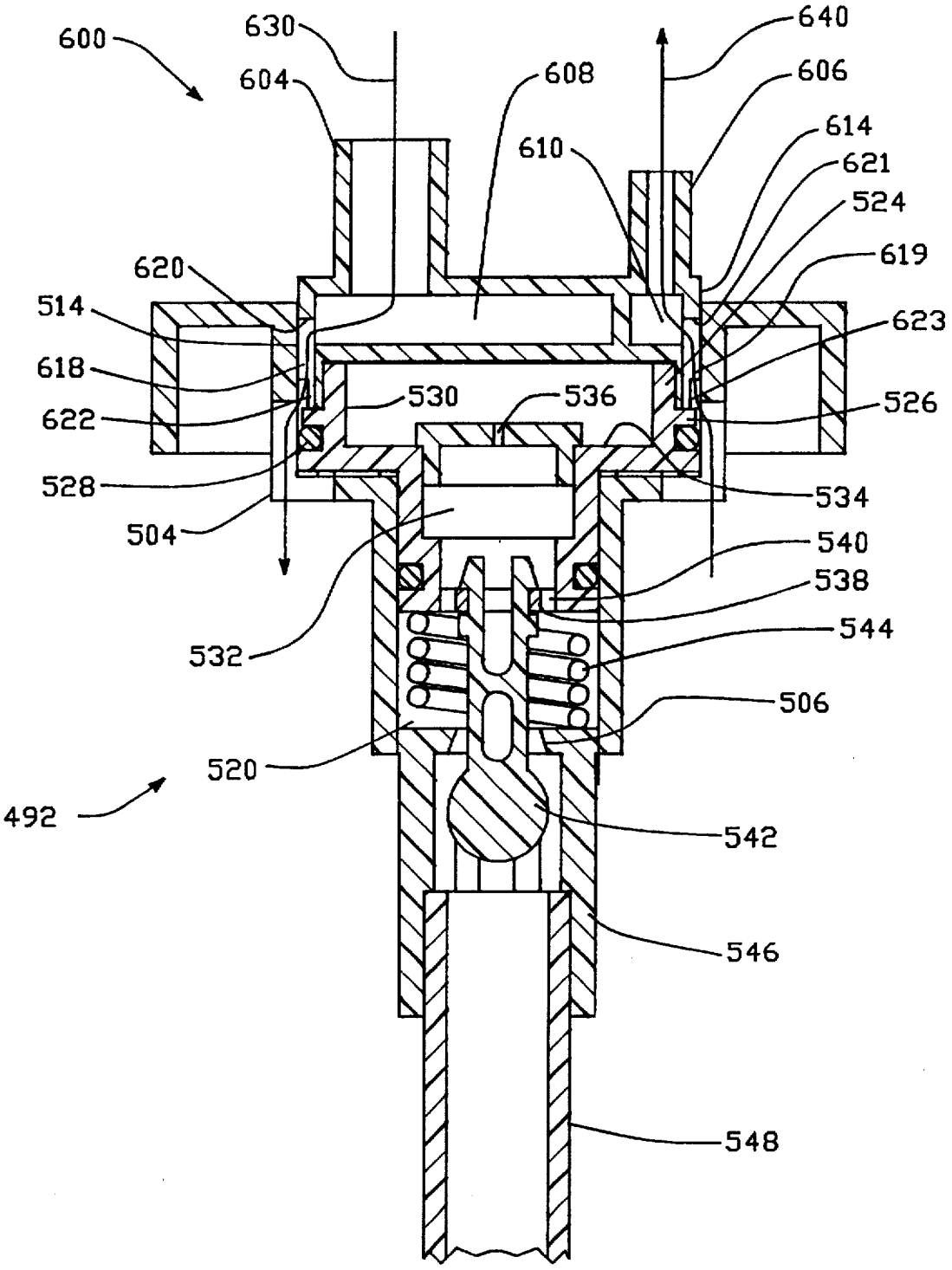
FIG. 8*g* is a cross-sectioned view similar to FIG. 8*f* but with the refill head pressing the valve plunger of the valve mechanism into an open position.

Turning to FIGS. 8*f* and 8*g*, the refill head plunger 600 is shown mated to the valve plunger 524 of the valve mechanism 492. In FIG. 8*f*, recess 612 receives the upper end of the first cylindrical cavity 530 of the valve plunger 524. The peripheral wall 614 of plungers 600 is received about the plunger 524. The peripheral wall 614 is additionally received adjacent to the peripheral wall 514 of the valve mechanism 492. With respect to FIG. 8*f*, the valve plunger 524 is still in its closed position and thus no fluid passes between the filling head 600 and the bottle 312, 422 (not shown).

In FIG. 8*g*, the valve plunger 524 is in an open position.

Accordingly, concentrated fluid can be dispensed into the bottle 312, 422 (not shown), in order to refill the bottle. This is accomplished by using the movement of the refill head plunger 600 to urge the valve plunger 524 into the second open position or by causing the plunger 524 to be urged up against a stationary fill head plunger 600 and thus positioned into the open position as shown in FIG. 8*g*. Concentrate is dispensed into the bottle along, for example, path 630. Air is vented from the bottle along path 640. Examining path 630, concentrate enters the concentrate inlet port 604 and proceeds to the internal plenum 608. From there it exits port 620 to scalloped recesses 618 to peripheral indentation 622 to the vent port 504 of the valve mechanism 492 of the bottle in order to fill the bottle. As the bottle is filled, air is vented from the bottle through vent port 504 through the peripheral indentation 623 to the scalloped recesses 619 and the port 621 to the internal plenum 610 and out the air vent 606. Once the refilling operation is complete, the bottle 312, 422 is removed from the refill head 310 and the valve plunger 524 reverts to the first closed position, closing off the fluid port 506 and the vent port 504 so that no fluid can spill from the bottle 312, 422. The bottle can then be transported to a new location, such as for example, a satellite station.

For purposes of refilling the spray bottle 314 of handheld sprayer 350 (FIG. 6*a*), a refill head 310 has, for example, a straw like dispensing tube that fits into port 317 of bottle 314. Air is vented in the space between the side of the dispensing tube and port 317.

FIGS. 9, 10*a*, 10*b* and 10*c* depict a preferred embodiment 700 of the valve mechanism 492 (FIGS. 7*d* and 8*f*) of the bottle interconnect mechanism 490 (FIG. 7*c*). The mechanism 700 has been designed for enhanced manufacturability and retains all the novel features previously described. The preferred valve mechanism 700 includes a valve housing insert or valve plug 702, a valve plunger or concentrate valve 704, a valve sleeve 706, a valve retainer 708 and a spring 710. Also shown in FIGS. 10*a* and 10*b*, valve mechanism 700 mates with a plunger 712 which forms part of a filling head, such as filling head 420 in FIG. 7*a*. Inserted in plunger 712 is a metering orifice 714. The metering orifice 714 can be removed or changed for another size orifice in order to vary the flow rate of concentrate to the plunger 712. In this embodiment, located between plunger 712 and metering orifice 714, is a duckbill checkvalve 715 which prevents the leakage of fluid from the plunger 712 when the filling head 420 is removed from bottle 422 in FIG. 7*a*. Further checkvalve 715 prevents any back flow of fluid from filling head 420 into bottle 422.

Figure 9:
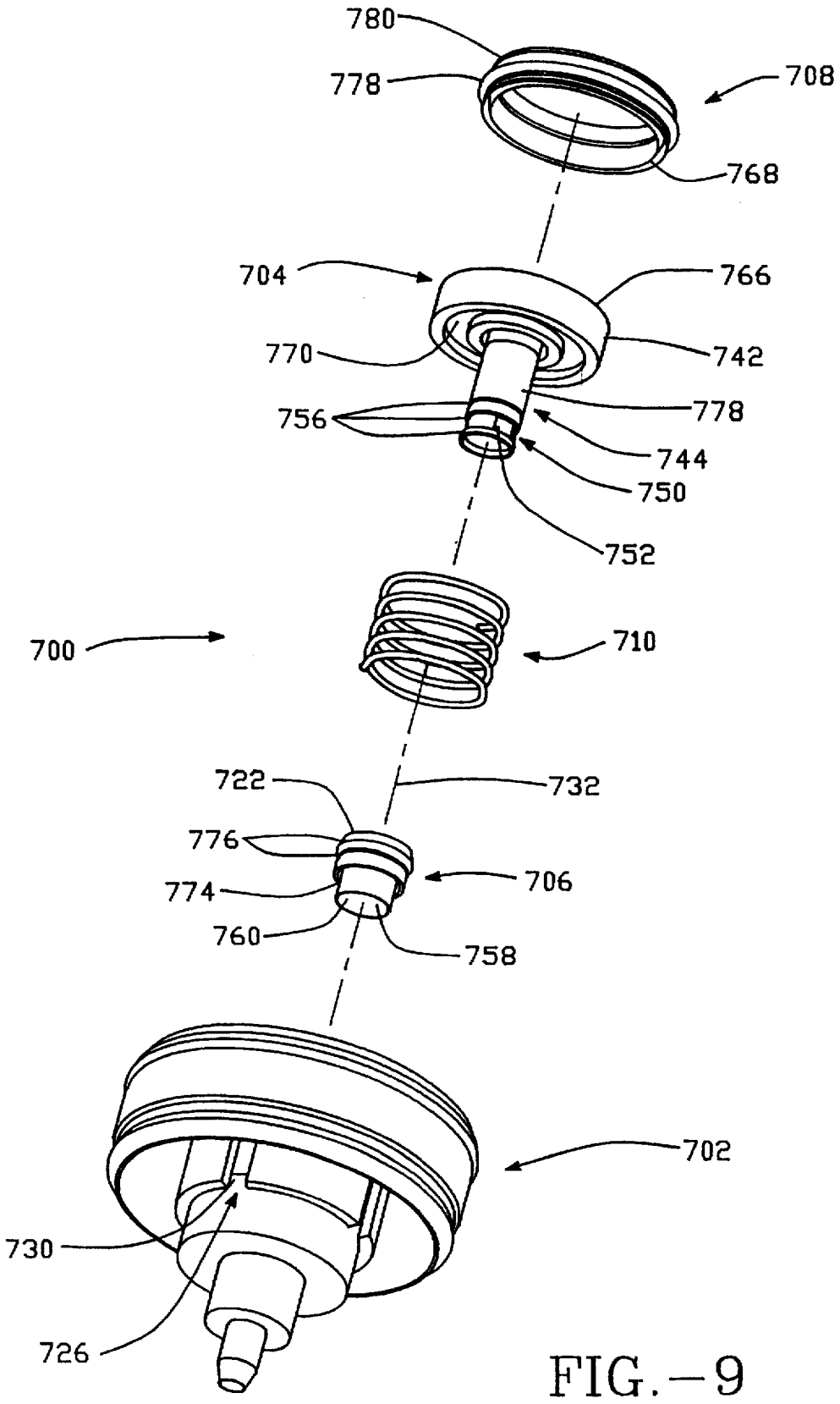
FIG. 9 is an exploded view of a preferred embodiment of a valve mechanism of the bottle interconnect mechanism for opening and closing the fluid and vent ports of the bottle.
Figure 10A:
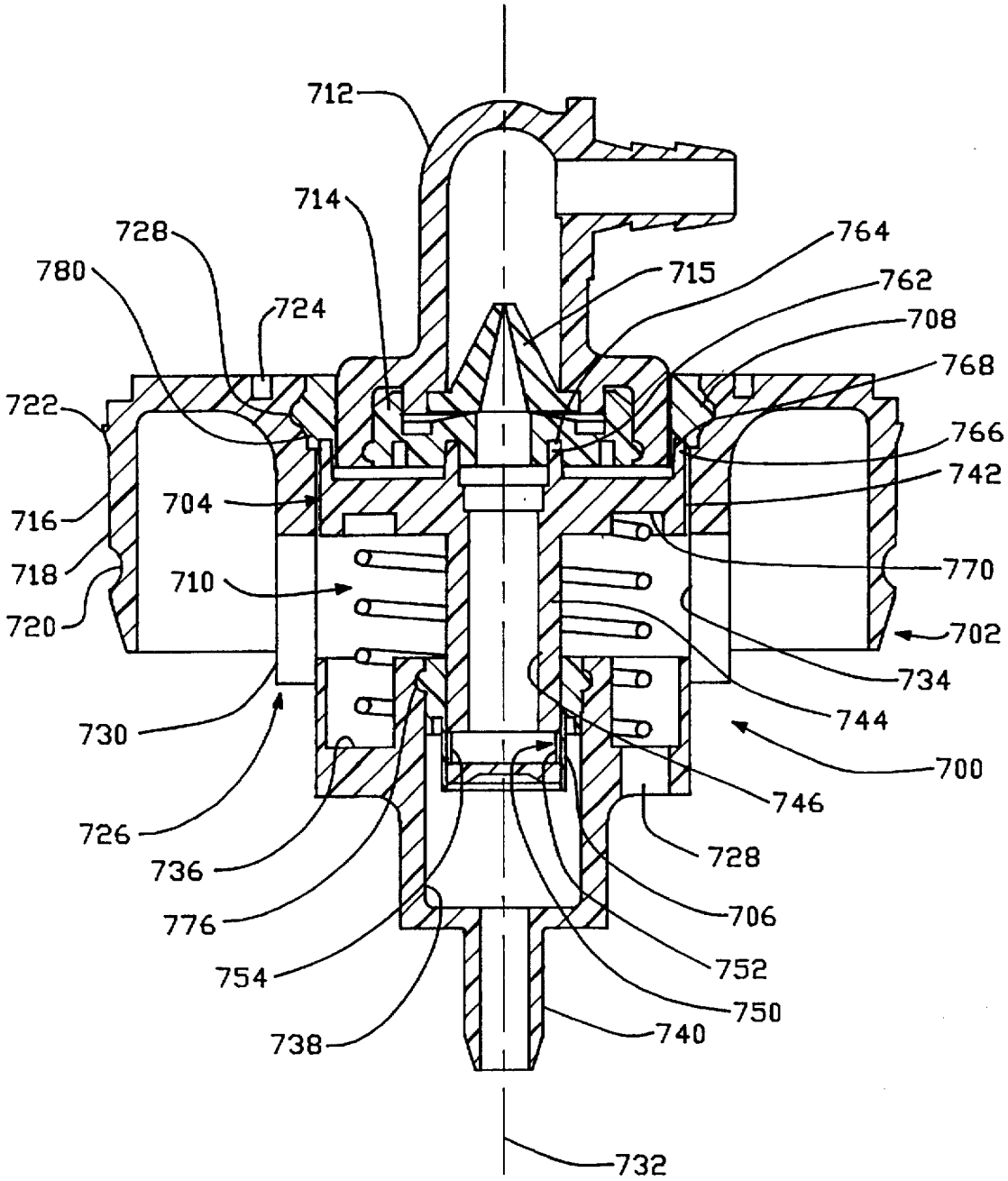
FIG. 10*a* is a cross-sectioned view of the valve mechanism of FIG. 9 with the valve mechanism in a closed position and shown with a plunger from a filling head.
Figure 10B:
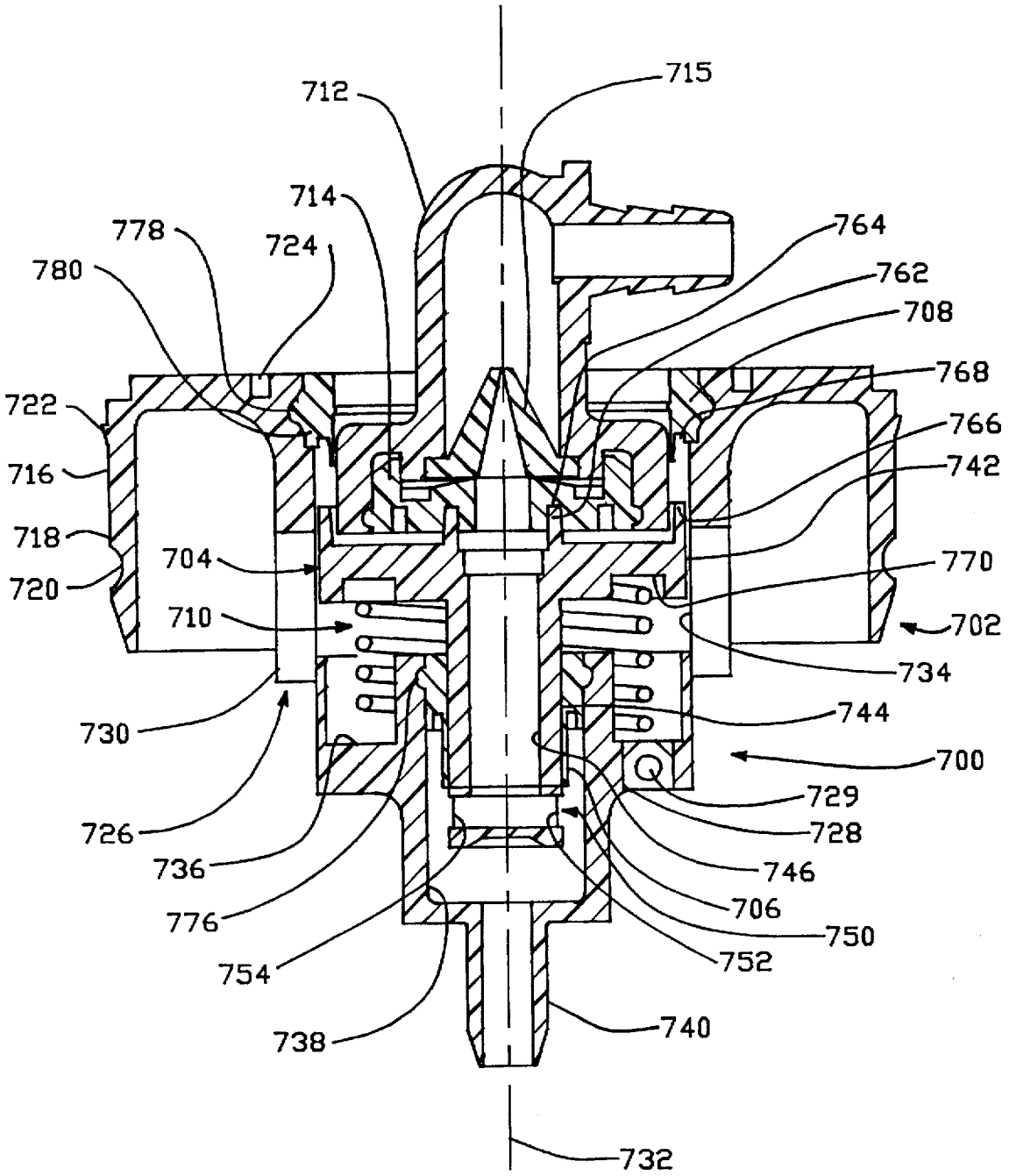
FIG. 10*b* is a view similar to FIG. 10*a* with the valve mechanism in the open position.

The valve plug or valve housing insert 702 as seen in FIGS. 9, 10*a* and 10*b*, includes a peripheral collar 716 which can snap into the upstanding collar 494 (FIG. 7*c*) of a bottle, such as bottle 422, through the use of a detent arrangement 718 which includes a female locking ring 720 which can mate with a male locking ring (not shown) of the bottle 422 to provide the primary bottle seal. The peripheral collar 716 also includes a barb sealing bead 722 which is located above the female locking ring 720. The barb sealing bead 722 provides a force fit between the valve plug 702 and the bottle 422 and acts as a secondary seal to retain the liquid in bottle 422. The valve plug 702 further includes a hinged valve retainer ring 724 which is flexible and allows the valve retainer 708 to be forced fit into the valve plug 702. Ring 724 also permits valve plug 702 to be molded without an internal mold parting line for better sealing because ring 724 can flex to permit the mold insert forming the interior to be removed.

As with the embodiment of FIGS. 7*d* and 8*f*, the valve plug 702 includes a vent or refill port 726. Vent port 726 allows make up air to be received in the bottle 422 in order to displace concentrate that is drawn from the bottle and also permits bottle 422 to be refilled with liquid. As can be seen in FIGS. 9, 10*a*, 10*b*, and 10*c*, vent port 726 includes a plurality of individual vent ports 730 which are rectangular in shape in this embodiment, and which are located on radii which project outwardly from a central axis 732. In a preferred embodiment, the individual vent ports 730 are located equally spaced about a first cylindrical cavity 734 (FIG. 10*a*) of the valve plug 702.

Immediately below the first cylindrical cavity 734 is a second cylindrical cavity 736. This cavity receives the lower end of the spring 710 and holds it in position. A drain or vent port 728 is provided through the wall of the second cylindrical cavity 736. Drain port 728 drains any fluid retained in the second cylindrical cavity 736 back into the bottle and can also serve as an air vent.

In an alternative embodiment where the bottle 422 is only intended for one time use, individual vent ports 730 of vent port 726 can be eliminated and drain port 728 can serve to allow make up air to be received within bottle 422. A check valve such as a ball check valve 729 can be engaged with drain port 728 to minimize escape of liquid from bottle 422 in case bottle 422 is squeezed while the plunger of concentrate valve 704 is deliberately held open when it is not connected to filling head 420. Although check valve 729 is shown in the embodiment of FIG. 10*b*, check valve 729 can be eliminated from this embodiment (as shown in FIG. 10*b*) and be within the spirit and scope of the invention.

Inwardly and downwardly from the second cylindrical cavity 736 is a third cylindrical cavity 738 which receives the valve sleeve 706 in order to properly position the plunger or valve 704 relative to the valve plug 702. Valve sleeve 706 is preferably press fit into position. Extending downwardly and communicating with the third cylindrical cavity 738 is a nipple 740 to which a draw tube can be received in order to draw fluid out from the bottle 422.

The plunger or concentrate valve 704 includes a squat cylindrical body 742 with a hollow cylindrical column 744 extending downwardly therefrom along a central axis 732. At the distal end of the cylindrical column 744 and defined through the exterior cylindrical surface 748 is a fluid port 750 which includes individual fluid ports 752 and 754. Concentrated fluid can be drawn through the individual fluid ports 752, 754 up through the internal conduit 746 through the metering orifice 714 and through the plunger 712 in order to be dispensed by filling head 420 of FIG. 7*a*. As can be seen in FIG. 9, positioned below and above the fluid ports 750 are sealing beads 756. These sealing beads 756 rub against the internal cylindrical surface 758 of the cylindrical bore 760 of valve sleeve 706 (FIG. 9). These sealing beads 756 cause fluid port 750 to be sealed relative to the internal cylindrical surface 758 so that fluid cannot be drawn through the valve mechanism 700 with the valve in the closed position as shown in FIG. 10*a*. The sealing bead 756 below fluid ports 750 is slightly larger in diameter than the other two sealing beads 756 to provide better sealing. More than three sealing beads 756 could be present for better sealing although more beads 756 tend to create more resistance to opening the plunger. Fewer than three or no sealing beads 756 can also be used and still obtain good sealing. With the valve mechanism 700 in the open position shown in FIG. 10*b*, and with the concentrate valve 704 urged against the spring 710, the fluid port 750 extends below the distal end of the valve sleeve 706 so that vacuum can be delivered through the plunger 712 and the valve mechanism 700, to the fluid inside the bottle in order to draw concentrated fluid through the fluid port 750. Further, as can be seen in FIG. 10*b* with the valve mechanism 700 in the open position, with the concentrate valve 704 positioned downwardly, the vent port 726 is opened, allowing air to enter the bottle and replace fluid that is drawn out of the bottle. In the open position of FIG. 10*b*, sufficient air can pass between the valve 704 and the wall of the first cylindrical cavity 734, which are slightly spaced apart, and through vent port 726 to vent the bottle 422. The above is due to the fact that sealing of the vent port 726 primarily occurs as shown in FIG. 10*a* when the top sealing ring 766 of the valve 704 is received in the annular recess 768 of the valve retainer 708, where contact by sealing ring 766 with the angled sides of recess 768 provides a primary seal and contact with the bottom of recess 768 provides a secondary seal.

Figure 10C:
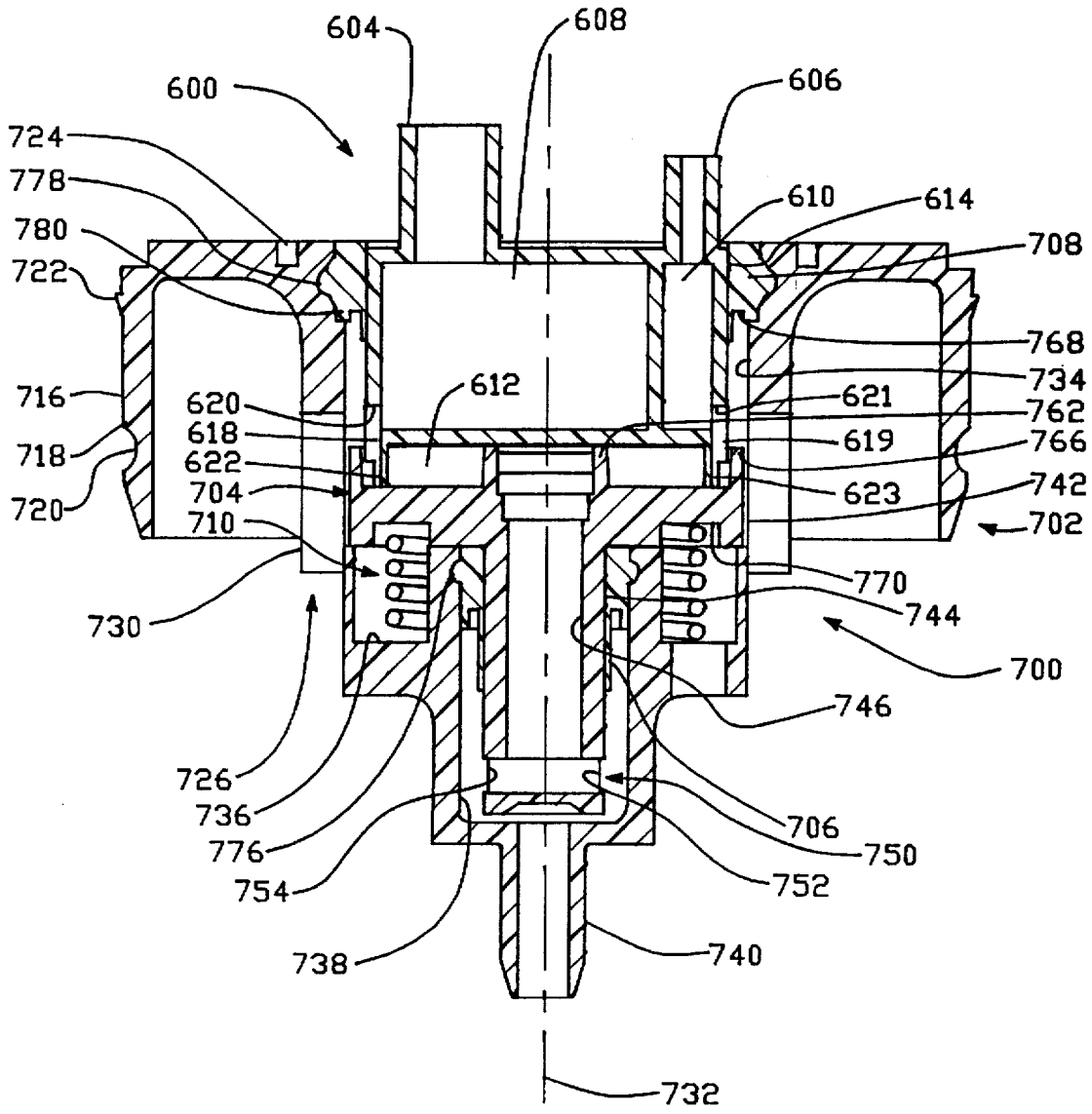
FIG. 10*c* is a view similar to FIG. 10*a* with the valve mechanism in the refill position, and with a refill head plunger.

As shown in FIG. 10*c*, the valve mechanism 700 has a refill position whereby the valve 704 is urged further downwardly and at least partially past the vent port 726. With the valve 704 so positioned, and with a refill head 600 such as shown in FIGS. 8*a*–8*g* positioned on the valve 704, the bottle can be rapidly refilled with concentrated fluid. It is noted that the refill head depicted in FIG. 10*c* serves the same function as that depicted in FIGS. 8*a*–8*e*, but is slightly elongated in FIG. 10*c*.

The concentrate valve 704 further includes an annular sealing bead 762 which is upstanding from the cylindrical body 742. The sealing bead 762 is received in a annular recess 764 defined in the metering orifice 714. With a plunger 712 received on the concentrate valve 704 as shown in FIGS. 10*a*, 10*b*, and 10*c*, the sealing bead 762 being received in the annular recess 764 ensures that there is no leakage between the valve mechanism 700 and the filling head 420 (from FIG. 7*a*). The concentrate valve 704 further includes a top sealing ring 766 that is received in annular recess 768 of the valve retainer 708 in order to create a seal between the valve 704 and the valve retainer 708 with the valve 704 in a closed position as shown in FIG. 10*a*. The valve 704 further includes a spring guide 770 which retains the top portion of the spring 710.

The valve sleeve 706 as described above provides for sealing of the fluid port 750 with the valve 704 in the closed position as shown in FIG. 10*a*. The valve sleeve 706 includes a body 722 and a sleeve 774 extending downward therefrom. The cylindrical bore 760 is defined inside of the sleeve 774. The sleeve 774 is sized to allow for some expansion as the valve 704 is inserted therethrough. The valve sleeve 706 on the external surface of the body 722 includes dual sealing beads 776 (similar to detent arrangement 718 where the lower sealing bead 776 is the primary seal and the upper sealing bead is the secondary seal) to ensure that there is proper sealing between the valve sleeve 706 and the valve plug 702, when the sleeve 706 is press fit into plug 702.

The valve retainer 708 has a sealing bead arrangement 778 on the exterior cylindrical surface 780. When valve retainer 708 is press fit into valve plug 702, the sealing bead arrangement 788 holds the retainer 708 in plug 702.

In the preferred embodiment, the spring 710 is specified as a thirteen pound (57.8 Newton) spring (in full compression) although the exact spring force will depend upon the opening and closing pressure desired for the trigger 40. The valve plug 702 in a preferred embodiment is made of low density polypropylene for ease of insertion into bottle 422, while the valve 704, the valve sleeve 706, and the valve retainer 708 are comprised of a polyethylene. The polypropylene is preferably one purchased from Eastman Plastics under the designation 1810A Tenite. If one desires to make valve plug 702 more difficult to remove from bottle 422, valve plug 702 can be made of a high density plastic such as high density polypropylene. For all these plastics, a mold release powder is added to the plastic resins in order to facilitate the release of the molded part from the mold.

Figure 2:
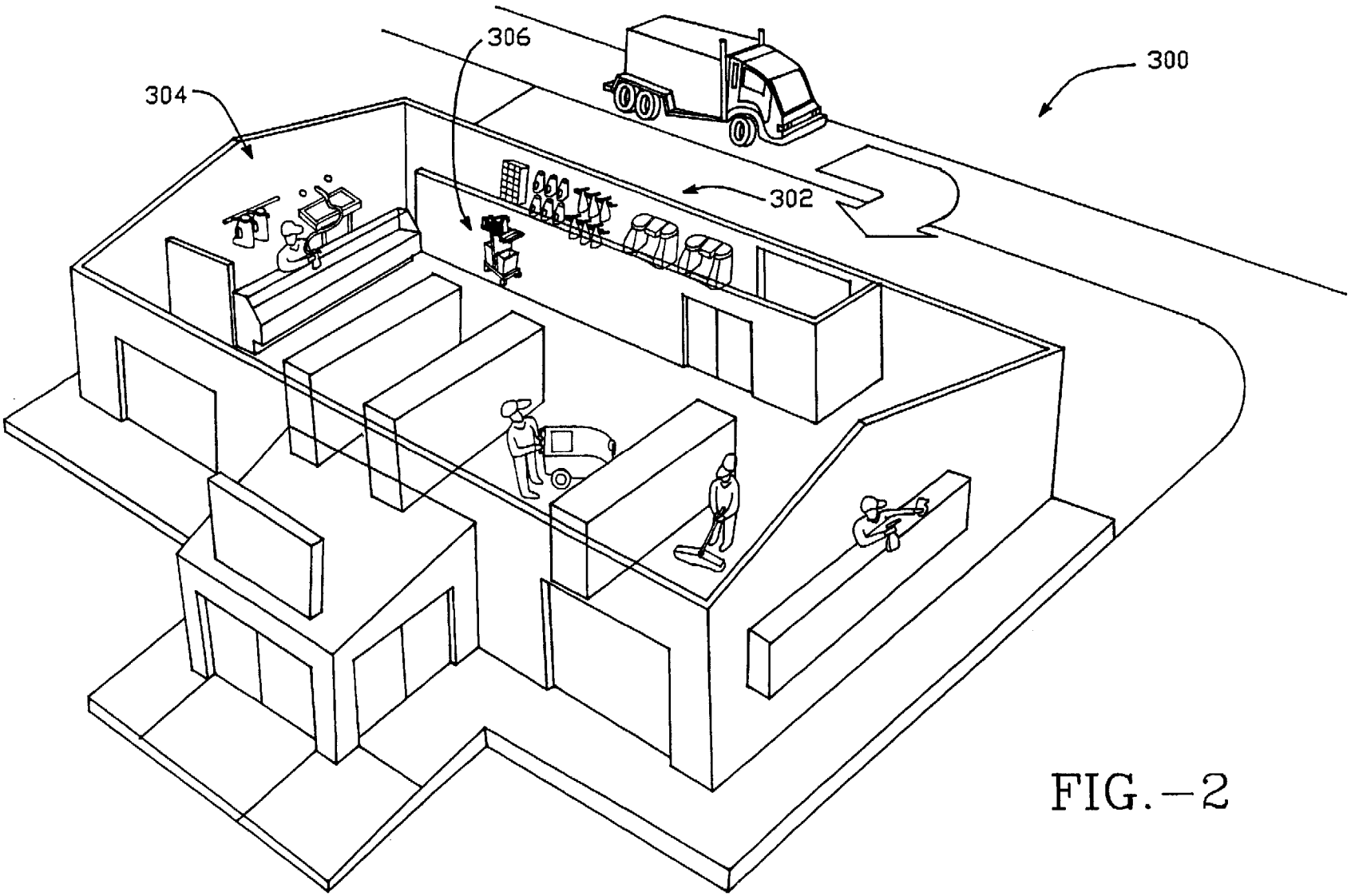
FIG. 2 depicts another embodiment of the method and system of the invention for use in a single story commercial or industrial facility.

The system of FIG. 2 includes all the aspects and features of the system and method of FIG. 1 except that in FIG. 2, all the functions are carried out on a single floor. However, as shown in FIG. 2, the system 300 includes a central station 302 with permanently mounted satellite stations 304 and mobile station 306.

Industrial Applicability

The system and method of the invention is advantageously designed to make the distribution of concentrated chemical fluids safe, efficient and trackable throughout a complex working environment. That being the case, efficiencies are afforded by the distribution of concentrated chemical fluids to the application site as opposed to the distribution of a diluted chemical fluids throughout the complex to the application site. Further, with the design of this system and method therefor, safety is afforded so that bottles which may have high concentrations are correctly filled or dispensed. Further, this system includes a tracking apparatus and method so that utilization of the concentration chemical fluids can be tracked and the efficiency thereof studied.

Other aspects, objects, and advantages of the invention can be obtained from a review of the figures and the appended claims.

It is to be understood that other embodiments of the method and system of the invention can be designed and come within the spirit and scope of the claims.

We claim:

1. A method for dispensing chemicals comprising the steps of:

storing a plurality of chemical concentrates at a central station which is capable of dispensing each of said plurality of concentrated chemicals;

providing a plurality of delivery bottles;

filling the delivery bottles with the appropriate concentrated chemicals from the central station;

distributing said plurality of filled delivery bottles to satellite stations located throughout a building;

securing the delivery bottles to the appropriate satellite stations;

diluting concentrated chemicals delivered in the delivery bottles with a diluting fluid at the satellite stations to form a mixture of chemicals;

and dispensing the mixture.

2. The method of claim 1 including:

wherein at least some of the satellite stations are portable, the step of moving the satellite station to a desired location.

3. The method of claim 1 including:

determining and storing information about the amount of each different type of concentrated chemical dispensed to each delivery bottle.

4. The method of claim 1 including the step of:

delivering concentrated chemicals to the central station.

5. The method of claim 1 including the step of having the delivery bottles be the same size and shape.

6. The method of claim 1 including;

providing satellite stations with various dilution ratios for the same concentrated chemicals.

7. The method of claim 1 including:

said storing step includes storing at the central station at least one of concentrated chemical cleaners and concentrated chemical disinfectants.

8. The method of claim 1 wherein:

at least one of said satellite stations is wall mounted; and at least one of said satellite station is portable.

9. A method for dispensing concentrated chemicals throughout a worksite in an efficient and economical manner that saves space and time, comprising the steps of;

storing and dispensing concentrated chemicals at a central location;

providing a plurality of delivery bottles;

filling said delivery bottles with the concentrated chemicals at said central location;

distributing said delivery bottles to a plurality of satellite stations which satellite stations can be either permanently located or portable; and diluting the concentrated chemicals with a diluting fluid at the satellite stations.

10. The method of claim 9 including the step of having the delivery bottles be of the same size and shape.

11. The method of claim 9 including;

providing satellite stations with various dilution ratios for the same concentrated chemical.

12. The method of claim 9 including:

said storing step includes storing at least one of concentrated chemical cleaners and chemical disinfectants.

13. A system for dispensing chemicals comprising:

a first central station having a plurality of bulk storage containers adapted for storing concentrated chemicals;

each of said containers having a dispensing head adapted for dispensing the concentrated chemicals;

a plurality of delivery bottles;

each of said delivery bottles having a filling port that allows the delivery bottle to be filled with concentrated chemicals from the first central station;

a plurality of satellite stations, each of said satellite having a first connector adapted to connect the satellite station to a source of diluting fluid;

each of said satellite stations having a second connector which allows one of said delivery bottles to be mated to the satellite station; and each of said satellite stations having a mix head that is adapted to dispense a mixture of at least one of the concentrated chemicals and the diluting fluid.

14. The system for dispensing chemicals of claim 13 wherein:

each of said satellite stations is one of (1) wall mounted or (2) portable.

15. The system of dispensing chemicals of claim 13 wherein:

a plurality of said satellite stations are mounted together.

16. The system of dispensing chemicals of claim 15 including:

a manifold adapted for dispensing a diluting fluid; and said manifold including a plurality of manifold ports which can mate with the first connectors of said satellite stations.

17. The system of claim 13 wherein:

at least some of said satellite stations include a plurality of second connectors so that a plurality of delivery bottles can be mated thereto; and said at least some of said satellite stations include a plurality of mix heads, each mix head for dispensing a different mixture of a concentrated chemical and a diluting fluid.

18. The system of claim 13 including:

an information storage device that can determine and store the number of times the delivery bottles are refilled.

19. The system of claim 13 including:

each of said delivery bottles is coded with indicia; and said central station includes readers that can read the indicia on said delivery bottles; and an information storage device that can determine and store the number of times the delivery bottles are refilled.

20. The system of claim 13 including;

each of said delivery bottles has a device that can store data; and said central station including a device that can transfer data to said devices of said delivery bottles.

21. The system of claim 13 including:

each of said dispensing bottles is encoded with indicia that indicates the type of chemicals that are in said dispensing bottle; and said system includes a device for reading said indicia.

22. The system of claim 13 wherein:

the delivery bottles are of the same shape and size.

23. The system of claim 13 including:

additional satellite stations which have mix heads that deliver different dilution ratios for the same concentrated chemicals.

24. The system of claim 13 wherein:

said central station can store at least one of concentrated chemical cleaners and concentrated chemical disinfectants.

25. A system for dispensing a plurality of different concentrated chemicals throughout a building and the environs of a building comprising:

a central station having a plurality of containers adapted for storing a plurality of different concentrated chemicals;

a plurality of delivery bottles;

each delivery bottle having a filling port that allows the delivery bottle to be filled with concentrated chemicals from the central station;

a plurality of satellite stations positioned throughout at least one of a building and the environs of a building;

at least some of said satellite stations being permanently assigned to a location of a building and the environs of a building;

said at least some of said satellite stations adapted to store a plurality of different concentrated chemicals;

said at least some of said satellite stations having a first connector adapted to connect the satellite station to a source of diluting fluid;

said at least some of said satellite stations having a plurality of second connectors which allow a plurality of said delivery bottles to be mated to said satellite stations; and said at least some of said satellite stations having a plurality of mix heads that are adapted to dispense a mixture of a concentrated chemical and the diluting fluid.

26. The system of claim 25 wherein:

said satellite stations including a plurality of portable satellite stations;

at least some of said portable satellite stations having a first connector adapted to connect each satellite station to a source of diluting fluid;

said at least some of said portable satellite stations having a second connector which allows one of said delivery bottles to be mated to each of said portable satellite stations; and said at least some of said portable satellite station having a mix head that is adapted to dispense a mixture of a concentrated chemical and the diluting fluid.

27. The system of claim 25 including:

a second plurality of delivery bottles; and each of said second plurality of delivery bottles having a filling port that allows each of said second plurality of delivery bottles to be filled at said central station.

28. The system of claim 27 wherein:

each of said second plurality of delivery bottles is smaller that each of said plurality of delivery bottles.

29. The system of claim 27 wherein:

each of said second plurality of delivery bottles is adapted to be mated with a hand held spray head.

30. The system of claim 25 including:

an information storage device that can determine and store the number of times the delivery bottles are refilled.

31. The system of claim 25 including:

each of said delivery bottles is coded with indicia; and said central station includes readers that can read the indicia on said delivery bottles; and an information storage device that can determine and store the number of times the delivery bottles are refilled.

32. The system of claim 25 including;

each of said delivery bottles has a device that can store data; and said central station including a device that can transfer data to said devices of said delivery bottles.

33. The system of claim 25 including:

each of said dispensing bottles is encoded with indicia what indicates the type of chemicals that are in said dispensing bottle; and said system includes a device which can read said indicia.

34. The system of claim 25 wherein the delivery bottles are of the same size and shape.

35. The system of claim 25 including:

additional satellite stations which have mix heads that deliver different dilution ratios for the same concentrated chemicals.

36. The system of claim 25 including:

some of said satellite stations include multiple mix heads, each mix head having a different dilution ratio for the same concentrated chemical.

* * * * *